US008622282B2

(12) United States Patent
Brundage et al.

(10) Patent No.: US 8,622,282 B2
(45) Date of Patent: Jan. 7, 2014

(54) BLANKS AND METHODS FOR FORMING REINFORCED CONTAINERS

(75) Inventors: David Joe Brundage, Salinas, CA (US); John Robert Huston, Pebble Beach, CA (US); Kenneth C. Smith, Hiram, GA (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 839 days.

(21) Appl. No.: 12/709,209

(22) Filed: Feb. 19, 2010

(65) Prior Publication Data

US 2011/0204131 A1 Aug. 25, 2011

(51) Int. Cl.
*B65D 5/10* (2006.01)
*B31B 1/26* (2006.01)
*B31B 1/50* (2006.01)

(52) U.S. Cl.
USPC ..... 229/157; 229/160; 229/170; 229/174

(58) Field of Classification Search
USPC ..... 229/156, 157, 160, 170, 172, 174, 185, 229/918, 919, 117.13, 117.14; 493/121, 493/137, 139, 140, 162
See application file for complete search history.

(56) References Cited

U.S. PATENT DOCUMENTS

| | | | | |
|---|---|---|---|---|
| 1,653,116 | A | 12/1927 | Parks | |
| 2,295,141 | A | 9/1942 | Van Wingen | |
| 2,568,204 | A * | 9/1951 | Recser | 229/174 |
| 3,268,149 | A * | 8/1966 | Brackett | 229/160 |
| 3,770,187 | A | 11/1973 | Faires et al. | |
| 3,989,181 | A * | 11/1976 | Wilcox et al. | 229/185 |
| 4,013,213 | A | 3/1977 | Giebel | |
| 4,068,796 | A | 1/1978 | Kullman, Jr. | |
| 4,260,100 | A | 4/1981 | Hoffman | |
| 4,770,339 | A * | 9/1988 | Weimer | 229/174 |
| 5,294,044 | A | 3/1994 | Clark | |
| 5,755,377 | A * | 5/1998 | Durand | 229/157 |
| 5,775,575 | A | 7/1998 | Dorman et al. | |
| 6,296,178 | B1 | 10/2001 | McKenna, Sr. | |
| 6,460,758 | B1 | 10/2002 | Fenton et al. | |
| 6,508,395 | B2 | 1/2003 | McLeod | |
| 6,641,032 | B1 | 11/2003 | Schilling | |
| 6,676,012 | B1 | 1/2004 | Southwell et al. | |
| 6,899,266 | B2 | 5/2005 | Conway | |
| 7,000,771 | B2 | 2/2006 | Kwong | |
| 7,290,696 | B2 | 11/2007 | McClure | |
| 7,484,655 | B2 | 2/2009 | McLeod | |
| 7,607,567 | B2 | 10/2009 | Fry et al. | |
| 8,177,117 | B2 * | 5/2012 | Little | 229/120.18 |
| 2002/0121542 | A1 | 9/2002 | Holladay | |
| 2002/0158114 | A1 | 10/2002 | Evans et al. | |

(Continued)

OTHER PUBLICATIONS http://sierrapack.com/fci.html; "1-2-3 Houghland Snap Lock Bottom"; Paperboard Packaging Council Handbook of Folding Carton Style Nomenclature; 1 page, Feb. 2010.

(Continued)

*Primary Examiner* — Gary Elkins
(74) *Attorney, Agent, or Firm* — Armstrong Teasdale LLP

(57) ABSTRACT

A blank of sheet material for forming a container is provided. The blank includes a first reinforcing end panel extending from a first end panel, a first corner post panel extending from a first edge of the first reinforcing end panel, and a first top end panel defined within the first reinforcing end panel.

24 Claims, 17 Drawing Sheets

(56) References Cited

U.S. PATENT DOCUMENTS

| | | | | |
|---|---|---|---|---|
| 2003/0024971 | A1 | 2/2003 | Jones et al. | |
| 2004/0211825 | A1 | 10/2004 | Champion et al. | |
| 2004/0256448 | A1 | 12/2004 | Blomfield et al. | |
| 2005/0011938 | A1 | 1/2005 | West | |
| 2005/0284922 | A1 | 12/2005 | Feltz | |
| 2007/0131746 | A1 | 6/2007 | Quaintance et al. | |
| 2007/0152027 | A1 | 7/2007 | Hyatt et al. | |
| 2007/0170234 | A1* | 7/2007 | Cargile, Jr | 229/157 |
| 2008/0078819 | A1 | 4/2008 | Strong et al. | |
| 2008/0110964 | A1 | 5/2008 | Churvis | |
| 2008/0116249 | A1 | 5/2008 | West | |
| 2009/0098991 | A1 | 4/2009 | Graham et al. | |

OTHER PUBLICATIONS http://sierrapack.com/fci.html; Sierra Packaging—Manufacturer of Custom Folding Cartons; Folding Carton Information; 6 pages, Dec. 2009.

U.S. Appl. No. 12/209,949, filed Sep. 12, 2008; titled "Container Having an Automatically Locking Bottom and Blanks for Making the Same"; 42 pages.

* cited by examiner

BLANKS AND METHODS FOR FORMING REINFORCED CONTAINERS

BACKGROUND OF THE INVENTION

The embodiments described herein relate generally to a single blank for forming a reinforced container and, more particularly, to a single blank for forming a reinforced container having corner posts.

At least some known containers that are used to transport and/or store products may be stacked one on the other when the products are being transported or stored. This layering of containers may sometime cause the containers on the lower layers may be deformed by compression forces applied thereto by the upper layers of containers. When a container deforms or crushes, products within the container may then be required to support the weight of the upper layers. As such, the products within the containers may be damaged during transport and/or storage. At least the containers on the lower layers can be reinforced to facilitate supporting the weight of the upper layers without the products in the lower layers of containers being damaged.

At least one known reinforced container is formed from multiple blanks of sheet material. More specifically, an un-reinforced container is formed from one blank, and additional end inserts are formed from the other blanks. The end inserts are then positioned within the un-reinforced container to reinforce at least the end panels of the un-reinforced container. Such reinforced containers are more costly than un-reinforced containers because of the additional blanks needed to form the inserts. Further, the multiple blanks require additional time to form the reinforced container. Moreover, keeping track of the different blanks can cause additional problems when trying to assemble a reinforced container and all of the needed blanks cannot be located. Accordingly, there is a need for a simpler blank for forming a reinforced container.

BRIEF DESCRIPTION OF THE INVENTION

In one aspect, a blank of sheet material for forming a container is provided. The blank includes a first reinforcing end panel extending from a first end panel, a first corner post panel extending from a first edge of the first reinforcing end panel, and a first top end panel defined within the first reinforcing end panel.

In another aspect, a container formed from a blank of sheet material is provided. The container includes a first end wall formed from a first end panel and an interconnected first reinforcing end panel positioned in face-to-face relationship with the first end panel, a first top end panel extending from the first end panel, and a bottom wall oriented substantially perpendicularly to the first end wall. The bottom wall includes a plurality of bottom panels interlocked together using a bottom locking mechanism.

In yet another aspect, a method for forming a container from a blank of sheet material is provided. The method includes rotating a plurality of panels about a plurality of fold lines to form at least a portion of a first side wall, an opposing second side wall, a first end wall, and an opposing second end wall. At least one end reinforcing panel is rotated with respect to the first end wall and/or the second end wall and a top end panel extending from the first end wall and/or the second wall to form a portion of the first end wall and/or the second end wall. The method further includes rotating at least one corner post panel with respect to the at least one reinforcing end panel to form at least one corner post within the container.

In still another aspect, a locking mechanism for use with a container formed from a blank of sheet material is provided. The blank includes a first top panel, a second top panel, a third top panel, and a fourth top panel. The locking mechanism includes at least one locking cutout defined in the first top panel, at least one locking flap defined by the second top panel, a minor cutout defined through the second top panel adjacent the at least one locking flap, and at least one locking tab defined by at least one of the third top panel and the fourth top panel. The at least one locking tab is configured to be inserted through the at least one locking cutout and the minor cutout and secured in position by the at least one locking flap.

BRIEF DESCRIPTION OF THE DRAWINGS

FIG. 1 is a top plan view of an exemplary blank of sheet material.

FIG. 2 is a top perspective view of a container formed from the blank shown in FIG. 1.

FIG. 3 is a top perspective view of the container shown in FIG. 2 with a top wall formed.

FIG. 4 is a bottom perspective view of the container shown in FIG. 2.

FIG. 5 is a top plan view of a first alternative blank of sheet material.

FIG. 6 is a top perspective view of a container formed from the blank shown in FIG. 5.

FIG. 7 is a top perspective view of the container shown in FIG. 6 with a top wall formed.

FIG. 8 is a top plan view of a second alternative blank of sheet material.

FIG. 9 is a top perspective view of a container formed from the blank shown in FIG. 8.

FIG. 10 is a top perspective view of the container shown in FIG. 9 with a top wall formed.

FIG. 11 is a top plan view of a third alternative blank of sheet material.

FIG. 12 is a top perspective view of a container formed from the blank shown in FIG. 11.

FIG. 13 is a top perspective view of the container shown in FIG. 12 with a top wall formed.

FIG. 14 is a top plan view of a fourth alternative blank of sheet material.

FIG. 15 is a top perspective view of a container formed from the blank shown in FIG. 14.

FIG. 16 is a top perspective view of the container shown in FIG. 15 with a top wall formed.

FIG. 17 is a bottom perspective view of the container shown in FIG. 15.

DETAILED DESCRIPTION OF THE INVENTION

Figure 1:
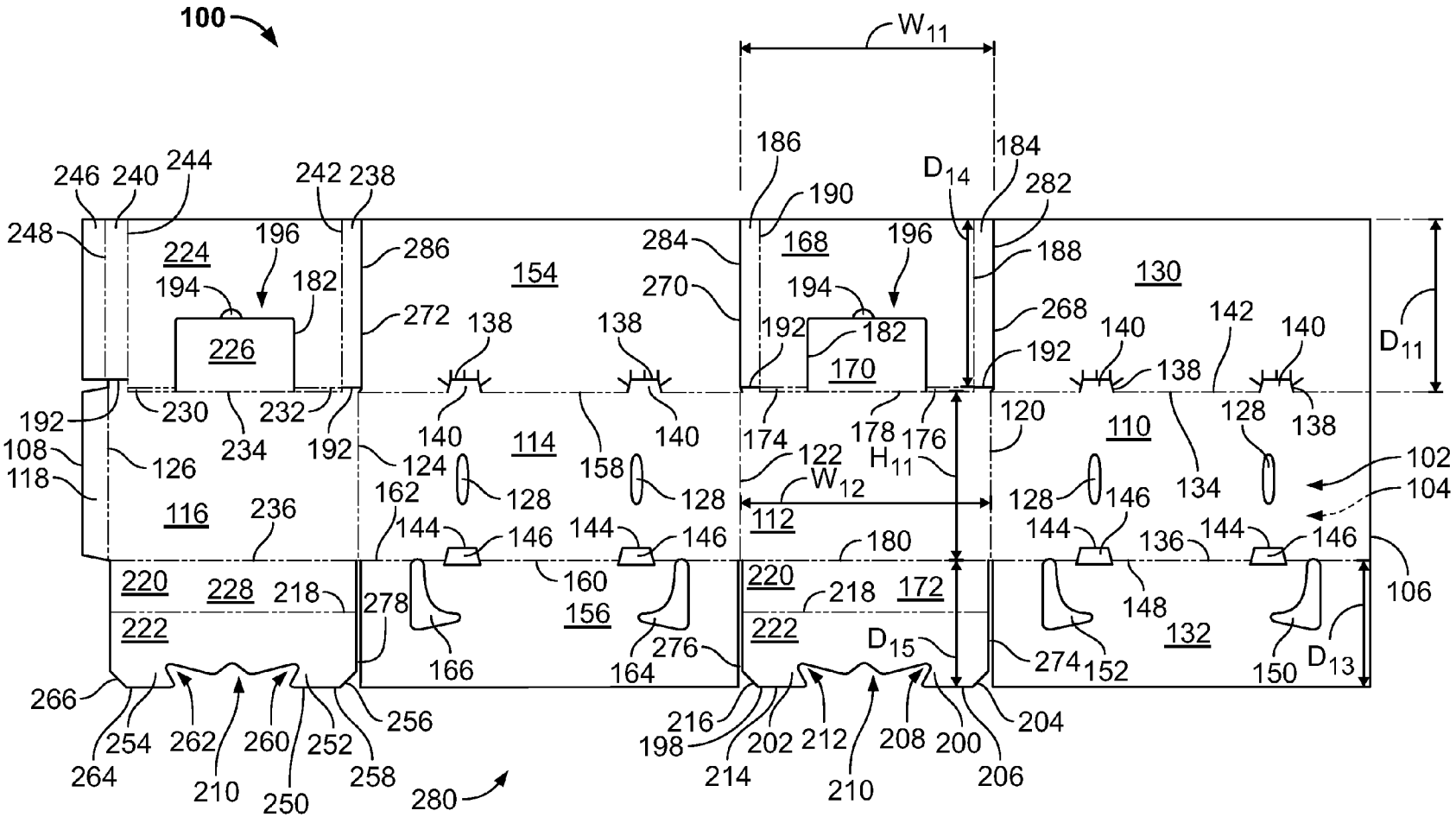
FIGS. 1-17 show exemplary embodiments of the apparatus and methods described herein.

The following detailed description illustrates the disclosure by way of example and not by way of limitation. The description clearly enables one skilled in the art to make and use the disclosure, describes several embodiments, adaptations, variations, alternative, and use of the disclosure, including what is presently believed to be the best mode of carrying out the disclosure.

The present invention provides a container that includes integral corner posts, and a method for constructing the container. The container is constructed from a blank of sheet material using a machine and/or by hand. For example, the blank can be wrapped about a mandrel to form a knocked-down flat container, and the final construction of the container can be performed by hand and/or by another machine. Alternatively, a folder/glue machine can be used to convey the blank through folder arms and adhesive applicator to form the knocked-down flat container. In one embodiment, the container is fabricated from a paperboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In the example embodiment, the container includes integrated corner posts. As such, the container can be formed from a single blank of sheet material. Accordingly, the containers described herein do not require separate inserts to form the corner posts. Further, the embodiments described herein include reinforced end walls that enable the container to be stacked. More specifically, the reinforced end walls and corner posts enable the containers described herein to be stronger than similar containers without reinforced end walls and/or corner posts, especially when subjected to vertical compression.

In an example embodiment, the container and/or a blank includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. In another embodiment, the container is void of markings, such as, without limitation, indicia that communicates the product, a manufacturer of the product and/or a seller of the product. Furthermore, the container may have any suitable size, shape and/or configuration, i.e., any suitable number of sides having any suitable size, shape and/or configuration as described and/or illustrated herein. In one embodiment, the container includes a shape that provides functionality, such as a shape that facilitates packaging a food item, a shape that facilitates transporting the container, and/or a shape that facilitates stacking and/or arrangement of a plurality of containers.

Further, different embodiments described here can vary in size and/or dimensions although similar labels are used for each embodiment. For example, although a depth is labeled similarly throughout the description, each embodiment can have varying depths.

Figure 2:
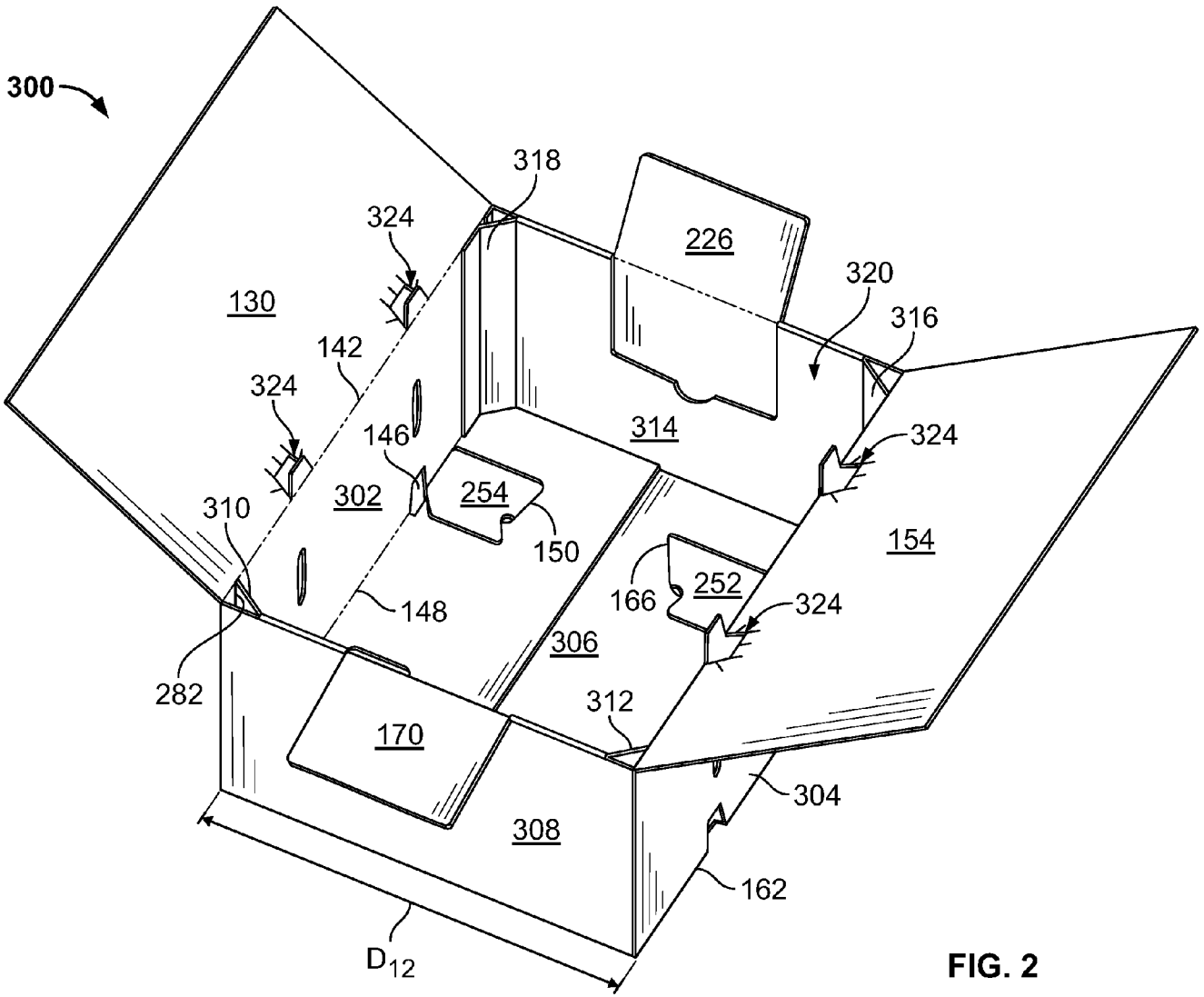
Figure 3:
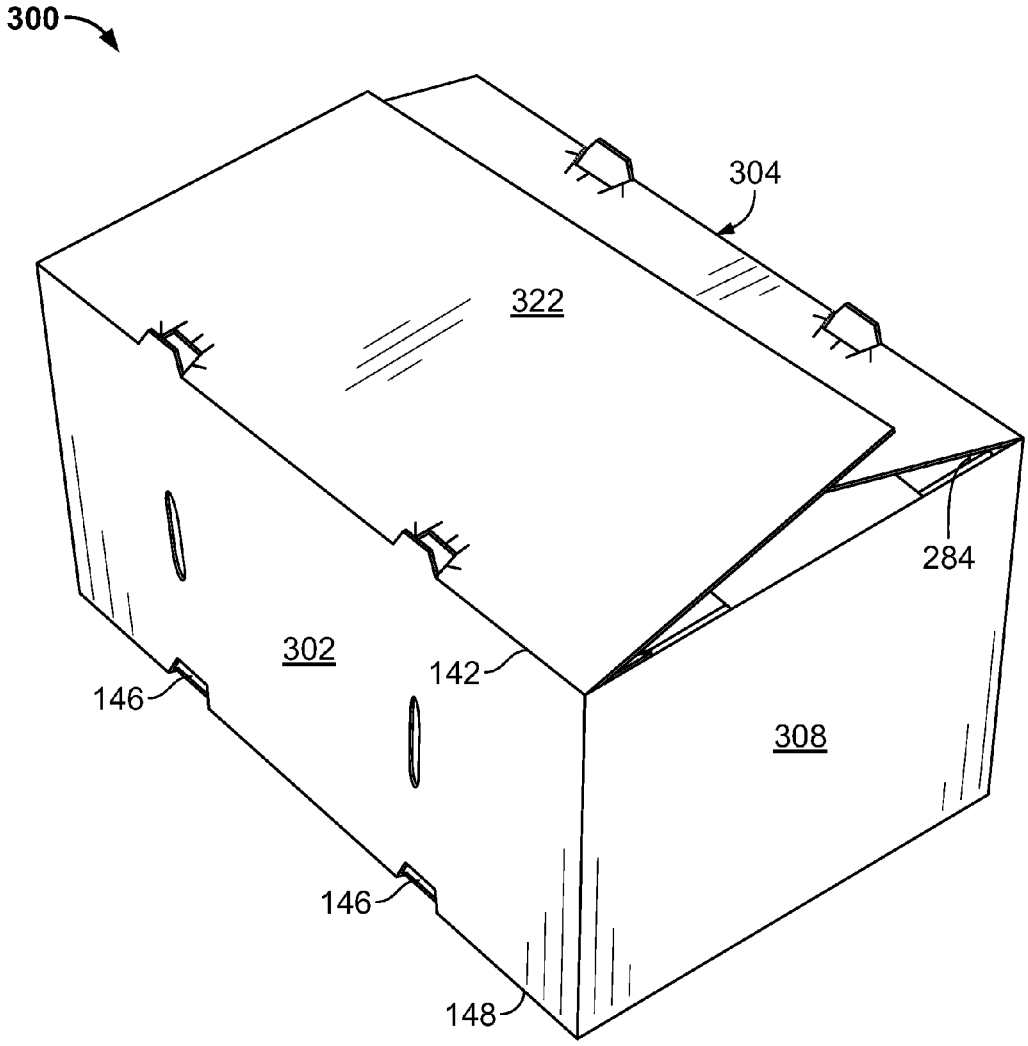
Figure 4:
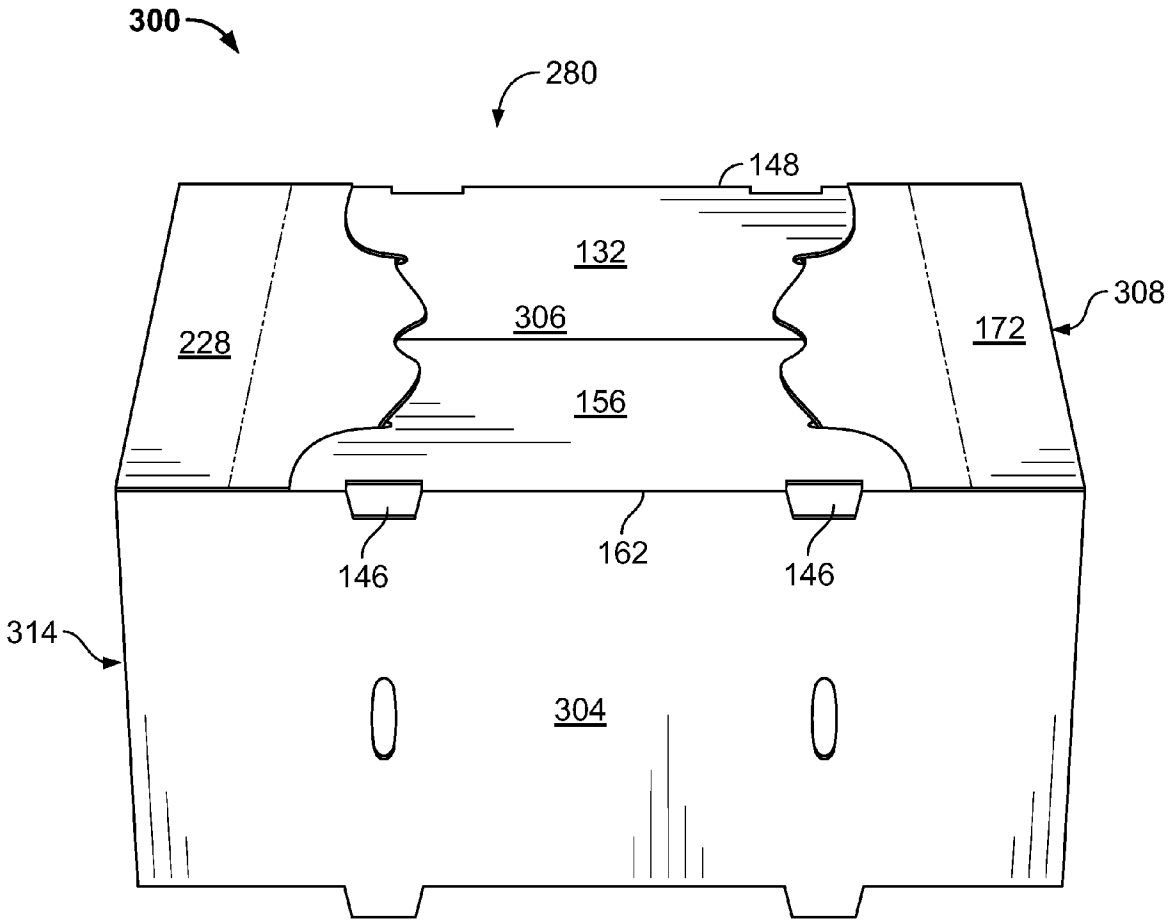

Referring now to the drawings, and more specifically to FIGS. 1-4, although as described above a container may have any suitable size, shape, and/or configuration, FIGS. 1-4 illustrate the construction or formation of one embodiment of a container. Specifically, FIG. 1 is a top plan view of an exemplary blank 100 of sheet material. FIG. 2 is a top perspective view of a container 300 formed from blank 100. FIG. 3 is a top perspective view of container 300 with a top wall 322 formed. FIG. 4 is a bottom perspective view of container 300.

Referring to FIG. 1, blank 100 has a first or interior surface 102 and an opposing second or exterior surface 104. Further, blank 100 defines a leading edge 106 and an opposing trailing edge 108. In one embodiment, blank 100 includes, from leading edge 106 to trailing edge 108, a first side panel 110, a first end panel 112, a second side panel 114, a second end panel 116, and a glue flap 118 coupled together along preformed, generally parallel, fold lines 120, 122, 124, and 126, respectively. More specifically, first side panel 110 extends from first end panel 112 along fold line 120, second side panel 114 extends from first end panel 112 along fold line 122, second end panel 116 extends from second side panel 114 along fold line 124, and glue flap 118 extends from second end panel 116 along fold line 126. Fold lines 120, 122, 124, and/or 126, as well as other fold lines and/or hinge lines described herein, may include any suitable line of weakening and/or line of separation known to those skilled in the art and guided by the teachings herein provided. In the exemplary embodiment, each side panel 110 and 114 includes elongated vent holes 128. It should be understood that any panel and/or portion of blank 100 can include vent holes 128 having any suitable shape and/or configuration. In a particular embodiment, blank 100 does not include any vent holes 128.

First side panel 110 includes a first top side panel 130 and a first bottom side panel 132 extending therefrom along respective fold lines 134 and 136. More specifically, first top side panel 130 extends from first side panel 110 along fold line 134, and first bottom side panel 132 extends from first side panel 110 along fold line 136. In the exemplary embodiment, fold line 134 includes cut lines 138. More specifically, cut lines 138 each define a tab portion 140. When blank 100 is assembled to construct container 300 (shown in FIGS. 2-4), tab portions 140 extend from a top edge 142 of first side panel 110 to define openings 324 (shown in FIG. 2) extending through container 300. Although cut lines 138 and tab portions 140 are shown and described as extending from fold line 134 and/or first side panel 110, fold line 134 and/or first side panel 110 is not required to include cut lines 138 and tabs portions 140. In the exemplary embodiment, fold line 136 includes cutouts 144 that define bottom vent holes 146 along a bottom edge 148 of first side panel 110 when container 300 is formed. Although cutouts 144 are shown and described as extending from fold line 136 and/or first side panel 110, fold line 136 and/or first side panel 110 is not required to include cutouts 144. In a particular embodiment, bottom vent holes 146 and tab portions 140 are configured such that, when containers 300 are stacked, tab portions 140 of a lower container 300 insert into bottom vent holes 146 of an upper container 300.

In the exemplary embodiment, first top side panel 130 is substantially rectangular and has a depth $D_{11}$ that is more than half of a depth $D_{12}$ (shown in FIG. 2) of container 300. Alternatively, first top side panel 130 has any suitable depth that enables blank 100 and/or container 300 to function as described herein. First bottom side panel 132 is substantially rectangular and has a depth $D_{13}$ that is about half of depth $D_{12}$ of container 300. Alternatively, first bottom side panel 132 has any suitable depth that enables blank 100 and/or container 300 to function as described herein. In the exemplary embodiment, first bottom side panel 132 includes a first locking slot 150 and a second locking slot 152. Each locking slot 150 and 152 is generally L-shaped, and second locking slot 152 is a mirror-image of first locking slot 150.

Similarly, second side panel 114 includes a second top side panel 154 and a second bottom side panel 156 extending therefrom along respective fold lines 158 and 160. More specifically, second top side panel 154 extends from second side panel 114 along fold line 158, and second bottom side panel 156 extends from second side panel 114 along fold line 160. In the exemplary embodiment, fold line 158 includes cut lines 138. More specifically, cut lines 138 each define tab portions 140, as described above. Although cut lines 138 and tab portions 140 are shown and described as extending from fold line 158 and/or second side panel 114, fold line 158 and/or second side panel 114 is not required to include cut lines 138 and tab portions 140. In the exemplary embodiment, fold line 160 includes cutouts 144 that define bottom vent holes 146, as described above, along a bottom edge 162 of second side panel 114 when container 300 is formed. Although cutouts 144 are shown and described as extending from fold line 160 and/or second side panel 114, fold line 160 and/or second side panel 114 is not required to include cutouts 144.

In the exemplary embodiment, second top side panel 154 is substantially rectangular and has depth $D_{11}$. Alternatively, second top side panel 154 has any suitable depth, such as a depth other than depth $D_{11}$, that enables blank 100 and/or container 300 to function as described herein. Second bottom side panel 156 is substantially rectangular and has depth $D_{13}$. Alternatively, second bottom side panel 156 has any suitable depth, such as a depth other than depth $D_{13}$, that enables blank 100 and/or container 300 to function as described herein. In the exemplary embodiment, second bottom side panel 156 includes a third locking slot 164 and a fourth locking slot 166. Each locking slot 164 and 166 is generally L-shaped, and fourth locking slot 166 is a mirror-image of third locking slot 164.

First end panel 112 includes a first reinforcing end panel 168, a first top end panel 170, and a first bottom end panel 172 extending therefrom along respective fold lines 174, 176, 178, and 180. More specifically, first reinforcing end panel 168 extends from first end panel 112 along double fold lines 174 and 176, first top end panel 170 extends from first end panel 112 along fold line 178, and first bottom end panel 172 extends from first end panel 112 along fold line 180. In the exemplary embodiment, first top end panel 170 is defined within first reinforcing end panel 168 by a cut line 182. More specifically, cut line 182 defines a substantially rectangular and/or square shape of first top end panel 170. Alternatively, first top end panel 170 can have any suitable shape that enables blank 100 and/or container 300 to function as described herein. In a particular embodiment, blank 100 does not include first top end panel 170.

In the exemplary embodiment, first reinforcing end panel 168 is substantially rectangular and has a depth $D_{14}$ that is approximately equal to a height $H_{11}$ of first end panel 112. In a particular embodiment, depth $D_{14}$ and depth $D_{11}$ are substantially equal. Alternatively, first reinforcing end panel 168 has any suitable depth that enables blank 100 and/or container 300 to function as described herein. In the exemplary embodiment, first reinforcing end panel 168 includes a first corner post panel 184 and a second corner post panel 186 extending therefrom along respective fold lines 188 and 190. More specifically, first corner post panel 184 extends from first reinforcing end panel 168 along fold line 188, and second corner post panel 186 extends from first reinforcing end panel 168 along fold line 190. A width $W_{11}$ of first corner post panel 184, first reinforcing end panel 168, and second corner post panel 186 is wider than a width $W_{12}$ of first end panel 112. Each corner post panel 184 and 186 is separated from first end panel 112 by a cut line 192. Further, a cutout 194 is defined in first reinforcing end panel 168 along a top portion 196 of cut line 182. In the exemplary embodiment, cutout 194 is semi-circular. However, it should be understood that cutout 194 can have any suitable shape, configuration, and/or position with respect to first top end panel 170 that enables blank 100 and/or container 300 to function as described herein.

First bottom end panel 172 is generally rectangular and has a depth $D_{15}$ that corresponds to a location of locking slots 150, 152, 164, and/or 166 defined in bottom side panels 132 and 156. In the exemplary embodiment, a free edge 198 of first bottom end panel 172 defines a first locking tab 200 and a second locking tab 202. More specifically, free edge 198 includes a first angled portion 204, a first horizontal portion 206, a first notch 208, a middle indent 210, a second notch 212, a second horizontal portion 214, and a second angled portion 216. First locking tab 200 is defined by first angled portion 204, first horizontal portion 206, and first notch 208, and second locking tab 202 is defined by second notch 212, second horizontal portion 214, and second angled portion 216. Alternatively, locking tabs 200 and/or 202 and/or free edge 198 have any suitable configuration that enables blank 100 and/or container 300 to function as described herein. Further, in an alternative embodiment, middle indent 210 is not defined by free edge 198. In the exemplary embodiment, first bottom end panel 172 further includes a line of weakness 218 extending across first bottom end panel 172 substantially parallel to fold line 180. Line of weakness 218 divides first bottom end panel 172 into a first portion 220 extending from fold line 180 and a second portion 222 extending from line of weakness 218 to free edge 198. In an alternative embodiment, first bottom end panel 172 does not include line of weakness 218.

Similarly, second end panel 116 includes a second reinforcing end panel 224, a second top end panel 226, and a second bottom end panel 228 extending therefrom along respective fold lines 230, 232, 234, and 236. More specifically, second reinforcing end panel 224 extends from second end panel 116 along double fold lines 230 and 232, second top end panel 226 extends from second end panel 116 along fold line 234, and second bottom end panel 228 extends from second end panel 116 along fold line 236. In the exemplary embodiment, second top end panel 226 is defined within second reinforcing end panel 224 by cut line 182. More specifically, cut line 182 defines a substantially rectangular and/or square shape of second top end panel 226. Alternatively, second top end panel 226 can have any suitable shape that enables blank 100 and/or container 300 to function as described herein. In a particular embodiment, blank 100 does not include second top end panel 226.

In the exemplary embodiment, second reinforcing end panel 224 is substantially rectangular and has depth $D_{14}$. Alternatively, second reinforcing end panel 224 has any suitable depth that enables blank 100 and/or container 300 to function as described herein. In the exemplary embodiment, second reinforcing end panel 224 includes a third corner post panel 238 and a fourth corner post panel 240 extending therefrom along respective fold lines 242 and 244. More specifically, third corner post panel 238 extends from second reinforcing end panel 224 along fold line 242, and fourth corner post panel 240 extends from second reinforcing end panel 224 along fold line 244. Width $W_{11}$ of third corner post panel 238, second reinforcing end panel 224, and fourth corner post panel 240 is wider than width $W_{12}$ of second end panel 116. Alternatively, third corner post panel 238, second reinforcing end panel 224, and fourth corner post panel 240 has a width other than width $W_{11}$ and/or second end panel 116 has a width other than width $W_{12}$. In the exemplary embodiment, each corner post panel 238 and 240 is separated from second end panel 116 by cut line 192. Corner post panels 184, 186, 238, and 240 are substantially congruent in the exemplary embodiment; however, it should be understood that corner post panels 184, 186, 238, and/or 240 can have any suitable size, shape, and/or configuration that enables blank 100 and/or container 300 to function as described herein.

A side reinforcing panel 246 extends from fourth corner post panel 240 along a fold line 248. In the exemplary embodiment, side reinforcing panel 246 is substantially congruent to fourth corner post panel 240 and extends to about trailing edge 108; however, it should be understood that side reinforcing panel 246 can have any suitable shape and/or configuration that enables blank 100 and/or container 300 to function as described herein. Further, in the exemplary embodiment, cutout 194 is defined in second reinforcing end panel 224 along top portion 196 of cut line 182. Alternatively, second reinforcing end panel 224 does not include cutout 194.

Second bottom end panel 228 is generally rectangular and has depth $D_{15}$ that corresponds to a location of locking slots 150, 152, 164, and/or 166 defined in bottom side panels 132 and 156. Alternatively, second bottom end panel 228 has any suitable depth that enables blank 100 and/or container 300 to function as described herein. In the exemplary embodiment, a free edge 250 of second bottom end panel 228 defines a third locking tab 252 and a fourth locking tab 254. More specifically, free edge 250 includes a third angled portion 256, a third horizontal portion 258, a third notch 260, middle indent 210, a fourth notch 262, a fourth horizontal portion 264, and a fourth angled portion 266. Third locking tab 252 is defined by third angled portion 256, third horizontal portion 258, and third notch 260, and fourth locking tab 254 is defined by fourth notch 262, fourth horizontal portion 264, and fourth angled portion 266. Alternatively, locking tabs 252 and/or 254 and/or free edge 250 have any suitable configuration that enables blank 100 and/or container 300 to function as described herein. Further, in an alternative embodiment, middle indent 210 is not defined by free edge 250.

In the exemplary embodiment, second bottom end panel 228 further includes line of weakness 218 extending across second bottom end panel 228 substantially parallel to fold line 236. Line of weakness 218 divides second bottom end panel 228 into first portion 220 extending from fold line 236 and second portion 222 extending from line of weakness 218 to free edge 250. In an alternative embodiment, second bottom end panel 228 does not include line of weakness 218.

A cut line 268 separates first top side panel 130 from first corner post panel 184, a cut line 270 separates second corner post panel 186 from second top side panel 154, and a cut line 272 separates second top side panel 154 from third corner post panel 238. Further, a slot 274 separates first bottom side panel 132 from first bottom end panel 172, a slot 276 separates first bottom end panel 172 from second bottom side panel 156, and a slot 278 separates second bottom side panel 156 from second bottom end panel 228. Alternatively, slots can separate any of panels 130, 184, 186, 154, and/or 238 and/or cut lines can separate any of panels 132, 172, 156, and/or 228. In the exemplary embodiment, a bottom locking mechanism 280 includes locking slots 150, 152, 164, and 166 and locking tabs 200, 202, 252, and 254. Alternatively, bottom locking mechanism 280 can include any suitable components and/or configuration that enables container 300 to be formed from blank 100.

Referring to FIGS. 1-4, to construct container 300 from blank 100, first side panel 110 is rotated about fold line 120 toward interior surface 102 of first end panel 112, first end panel 112 is rotated about fold line 122 toward interior surface 102 of second side panel 114, second side panel 114 is rotated about fold line 124 toward interior surface 102 of second end panel 116, and glue flap 118 is rotated about fold line 126 toward interior surface 102 of second end panel 116. In the exemplary embodiment, after rotating panels 110, 112, 114, and 116 and glue flap 118 about fold lines 120, 122, 124, and 126, side panels 110 and 114 are substantially parallel to each other and substantially perpendicular to end panels 112 and 116. Panels 110, 112, 114, and 116 and glue flap 118 can be rotated about fold lines 120, 122, 124, and 126 by wrapping blank 100 about a mandrel within a machine. Alternatively, a folder/glue machine can be used to convey blank 100 through folder arms and adhesive applicator to form a knocked-down flat container.

Once 110, 112, 114, and 116 and glue flap 118 are rotated about fold lines 120, 122, 124, and 126, glue flap 118 is coupled to first side panel 110. For example, in the exemplary embodiment, interior surface 102 of glue flap 118 is adhered to exterior surface 104 of first side panel 110. Alternatively, exterior surface 104 of glue flap 118 is adhered to interior surface 102 of first side panel 110. Further, although adhesive is described herein, glue flap 118 can be coupled to first side panel 110 using any suitable fastener and/or technique. In the exemplary embodiment, once glue flap 118 is coupled to first side panel 110, first side panel 110 and glue flap 118 form a first side wall 302 of container 300, and second side panel 114 forms a second side wall 304 of container 300. From this configuration, partially formed container 300 can be collapsed into a knocked-down flat configuration for shipping and/or storage of container 300.

To continue construction of container 300, first bottom side panel 132 is rotated about fold line 136 toward interior surface 102 of first side panel 110, and second bottom side panel 156 is rotated about fold line 160 toward interior surface 102 of second side panel 114. In the exemplary embodiment, first bottom side panel 132 is substantially perpendicular to first side wall 302, and second bottom side panel 156 is substantially perpendicular to second side wall 304. First bottom end panel 172 is rotated about fold line 180 toward interior surface 102 of first end panel 112. Second portion 222 of first bottom end panel 172 is rotated slightly about line of weakness 218 toward interior surface 102 of first portion 220. In the exemplary embodiment, first bottom end panel 172 is not creased at line of weakness 218 when second portion 222 is rotated toward first portion 220. Rather, the slight rotation of second portion 222 facilitates inserting first locking tab 200 into second locking slot 152 and inserting second locking tab 202 into third locking slot 164. When first locking tab 200 is inserted into second locking slot 152, first notch 208 rests against an edge surrounding second locking slot 152. Similarly, when second locking tab 202 is inserted into third locking slot 164, second notch 212 rests against an edge surrounding third locking slot 164.

Further, second bottom end panel 228 is rotated about fold line 236 toward interior surface 102 of second end panel 116. Second portion 222 of second bottom end panel 228 is rotated slightly about line of weakness 218 toward interior surface 102 of first portion 220. In the exemplary embodiment, second bottom end panel 228 is not creased at line of weakness 218 when second portion 222 is rotated toward first portion 220. Rather, the slight rotation of second portion 222 facilitates inserting third locking tab 252 into fourth locking slot 166 and inserting fourth locking tab 254 into first locking slot 150. When third locking tab 252 is inserted into fourth locking slot 166, third notch 260 rests against an edge surrounding fourth locking slot 166. Similarly, when fourth locking tab 254 is inserted into first locking slot 150, fourth notch 262 rests against an edge surrounding first locking slot 150. As such, bottom locking mechanism 280 interlocks bottom side panels 132 and 156 and bottom end panels 172 and 228 to form a bottom wall 306 of container 300, as shown in FIGS. 2 and 4.

First corner post panel 184 is rotated about fold line 188 toward exterior surface 104 of first reinforcing end panel 168, and second corner post panel 186 is rotated about fold line 190 toward exterior surface 104 of first reinforcing end panel 168. In the exemplary embodiment, after rotation about fold lines 188 and 190, exterior surface 104 of corner post panels 184 and 186 are oriented at approximately 135° with respect to exterior surface 104 of first reinforcing end panel 168. Alternatively, exterior surface 104 of corner post panels 184 and 186 can be oriented at any suitable angled with respect to exterior surface 104 of first reinforcing end panel 168. In the exemplary embodiment, first reinforcing end panel 168 is rotated about double fold lines 174 and 176 toward interior surface 102 of first end panel 112. As first reinforcing end panel 168 is rotated, first top end panel 170 remains substantially planar with and extending upwardly from first end panel 112. First reinforcing end panel 168 is rotated into face-to-face relationship with first end panel 112. More specifically, interior surface 102 of first reinforcing end panel 168 is directly adjacent to and/or in direct contact with interior surface 102 of first end panel 112. A free edge 282 of first corner post panel 184 is adjacent first side wall 302, and a free edge 284 of second corner post panel 186 is adjacent second side wall 304. First end panel 112 and first reinforcing end panel 168 form a first end wall 308, first corner post panel 184 forms a first corner post 310, and second corner post panel 186 forms a second corner post 312.

Third corner post panel 238 is rotated about fold line 242 toward exterior surface 104 of second reinforcing end panel 224, fourth corner post panel 240 is rotated about fold line 244 toward exterior surface 104 of second reinforcing end panel 224, and side reinforcing panel 246 is rotated about fold line 248 toward exterior surface 104 of fourth corner post panel 240. In the exemplary embodiment, after rotation about fold lines 242, 244, and 248, exterior surface 104 of corner post panels 238 and 240 are oriented at approximately 135° with respect to exterior surface 104 of second reinforcing end panel 224 and exterior surface 104 of side reinforcing panel 246 is oriented at approximately 135° with respect to exterior surface 104 of fourth corner post panel 240. As such, exterior surface 104 of side reinforcing panel 246 is oriented substantially perpendicularly to exterior surface 104 of second reinforcing end panel 224. Alternatively, exterior surface 104 of corner post panels 238 and/or 240 and/or side reinforcing panel 246 can be oriented at any suitable angled with respect to exterior surface 104 of second reinforcing end panel 224.

In the exemplary embodiment, second reinforcing end panel 224 is rotated about double fold lines 230 and 232 toward interior surface 102 of second end panel 116. As second reinforcing end panel 224 is rotated, second top end panel 226 remains substantially planar with and extending upwardly from second end panel 116. Second reinforcing end panel 224 is rotated into face-to-face relationship with second end panel 116. More specifically, interior surface 102 of second reinforcing end panel 224 is directly adjacent to and/or in direct contact with interior surface 102 of second end panel 116. A free edge 286 of third corner post panel 238 is adjacent second side wall 304, and side reinforcing panel 246 is rotated into face-to-face relationship with first side wall 302. More specifically, interior surface 102 of side reinforcing panel 246 is directly adjacent to and/or in direct contact with interior surface 102 of first side panel 110. As such, side reinforcing panel 246 is included in first side wall 302. Second end panel 116 and second reinforcing end panel 224 form a second end wall 314, third corner post panel 238 forms a third corner post 316, and fourth corner post panel 240 forms a fourth corner post 318. Corner posts 310, 312, 316, and 318, side walls 302 and 304, end walls 308 and 314, and bottom wall 306 define a cavity 320 of container 300. When corner posts 310, 312, 316, and 318, side walls 302 and 304, end walls 308 and 314, and bottom wall 306, container 300 is considered to be in an open configuration, as shown in FIG. 2.

To close container 300, first top end panel 170 is rotated about fold line 178 toward interior surface 102 of first end panel 112, and second top end panel 226 is rotated about fold line 234 toward interior surface 102 of second end panel 116. More specifically, after rotation, first top end panel 170 is substantially perpendicular to first end panel 112 and second top end panel 226 is substantially perpendicular to second end panel 116. First top side panel 130 is rotated about fold line 134 toward interior surface 102 of first side panel 110, and second top side panel 154 is rotated about fold line 158 toward interior surface 102 of second side panel 114. More specifically, after rotation, first top side panel 130 is substantially perpendicular to first side panel 110 and second top side panel 154 is substantially perpendicular to second side panel 114. In the exemplary embodiment, top side panels 130 and 154 overlap when top side panels 130 and 154 are substantially parallel to bottom wall 306. Alternatively, top side panels 130 and 154 are sized such that top side panels 130 and 154 do not overlap when top side panels 130 and 154 are substantially parallel to bottom wall 306. In the exemplary embodiment, top side panels 130 and 154 rest on top end panels 170 and 226 while at least top side panels 130 and 154 are secured together using, for example, tape. As such, interior surface 102 of top side panels 130 and/or 154 is adjacent to and/or in direct contact with exterior surface 104 of top end panels 170 and 226. Top side panels 130 and 154 and top end panels 170 and 226 define top wall 322 of container 300.

Figure 5:
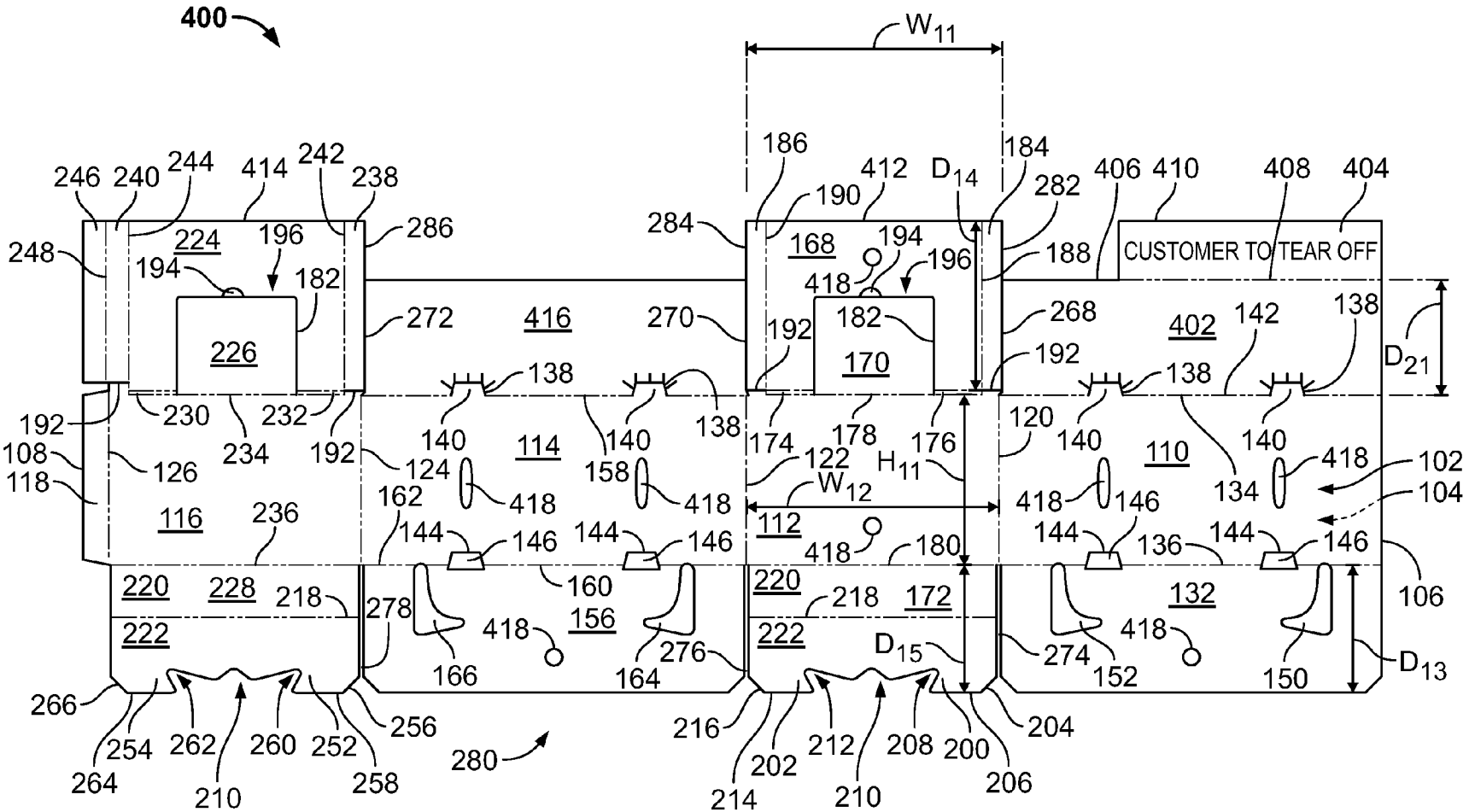
Figure 6:
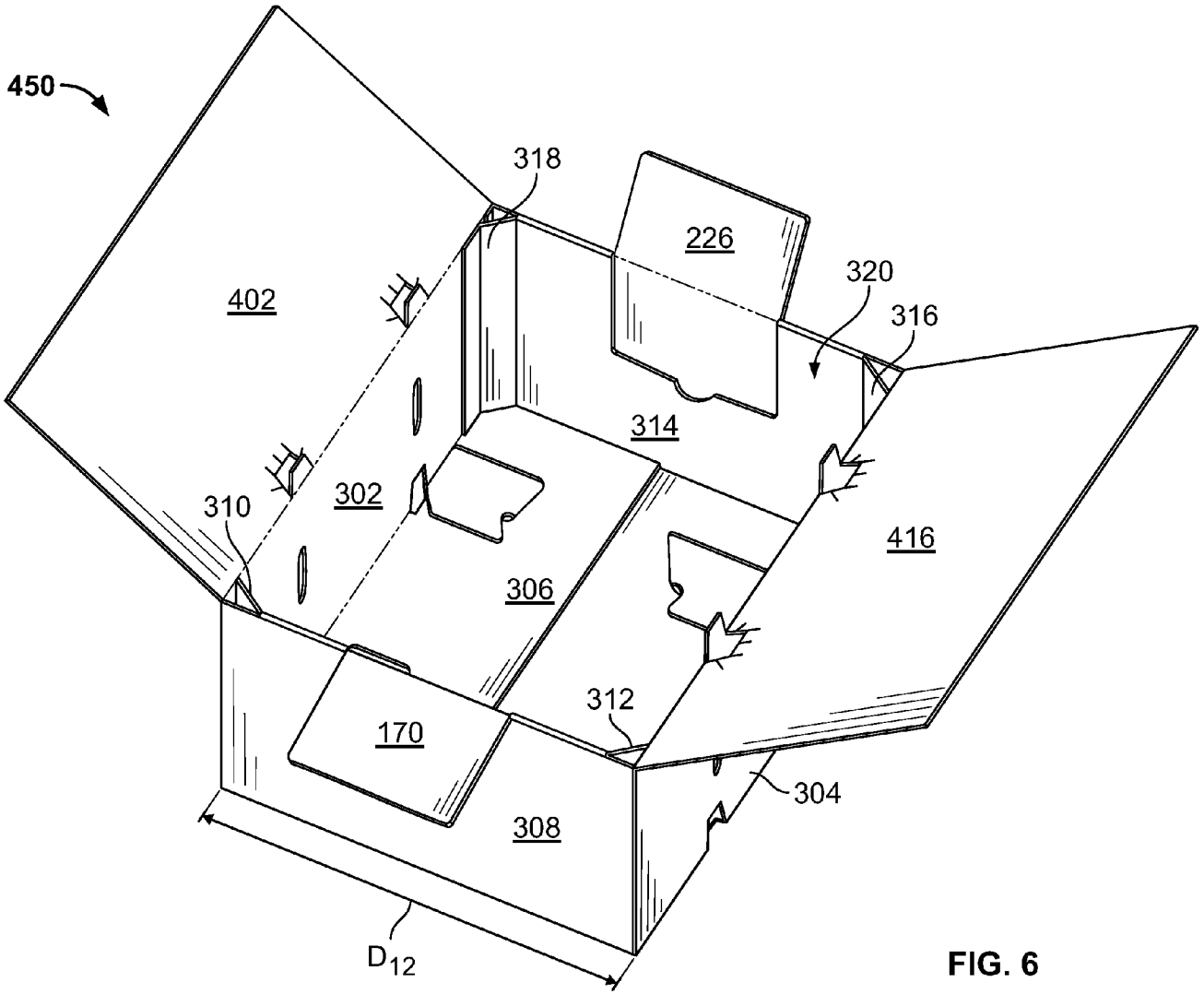
Figure 7:
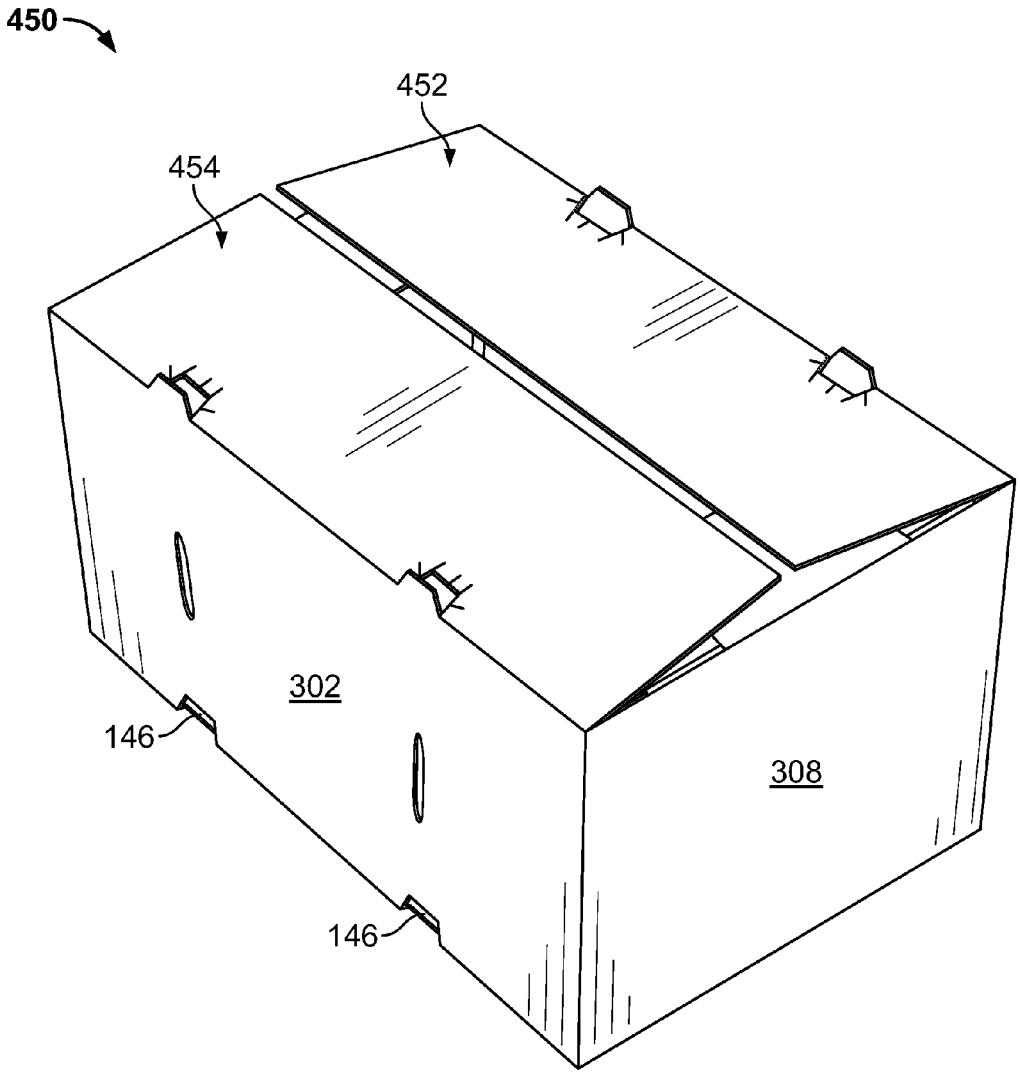

FIG. 5 is a top plan view a first alternative blank 400 of sheet material. FIG. 6 is a top perspective view of a container 450 formed from blank 400. FIG. 7 is a top perspective view of container 450 with a top wall 452 formed. Unless otherwise described, blank 400 includes components that are similar to the components described above with reference to blank 100 (shown in FIG. 1), and container 450 includes components that are similar to the components described above with reference to container 300 (shown in FIGS. 2-4). As such, components shown in FIGS. 1-4 are labeled with similar reference numbers in FIGS. 5-7.

Referring to FIG. 5, first side panel 110 includes a first top side panel 402 and first bottom side panel 132 extending therefrom along respective fold lines 134 and 136. More specifically, first top side panel 402 extends from first side panel 110 along fold line 134, and first bottom side panel 132 extends from first side panel 110 along fold line 136. In the exemplary embodiment, first top side panel 402 is substantially rectangular and has a depth $D_{21}$ that is about half of depth $D_{12}$ (shown in FIG. 6) of container 450. Alternatively, first top side panel 402 has any suitable depth that enables blank 400 and/or container 450 to function as described herein. In the exemplary embodiment, a removable alignment panel 404 extends from a top edge 406 of first top side panel 402 at a score line 408. Alignment panel 404 has a free edge 410 that substantially aligns with a widest portion of blank 400, such as free edges 412 and/or 414 of reinforcing end panels 168 and/or 224, respectively. Alternatively, blank 400 does not include alignment panel 404.

Similarly, second side panel 114 includes a second top side panel 416 and second bottom side panel 156 extending therefrom along respective fold lines 158 and 160. More specifically, second top side panel 416 extends from second side panel 114 along fold line 158, and second bottom side panel 156 extends from second side panel 114 along fold line 160. In the exemplary embodiment, second top side panel 416 is substantially rectangular and has depth $D_{21}$. Alternatively, second top side panel 416 has any suitable depth, such as a depth other than depth $D_{21}$, that enables blank 400 and/or container 450 to function as described herein.

In the exemplary embodiment, panels 110, 112, 114, 132, 156, and 168 each include vent holes 418. It should be understood that any panel and/or portion of blank 400 can include vent holes 418 having any suitable shape and/or configuration. In a particular embodiment, blank 400 does not include any vent holes 418.

Referring to FIGS. 5-7, container 450 is constructed from blank 400 in a manner similar to constructing container 300 (shown in FIGS. 2-4) from blank 100 (shown in FIG. 1). However, to close container 450, alignment panel 404 is removed from first top side panel 402 at score line 408. First top end panel 170 is rotated about fold line 178 toward interior surface 102 of first end panel 112, and second top end panel 226 is rotated about fold line 234 toward interior surface 102 of second end panel 116. More specifically, after rotation, first top end panel 170 is substantially perpendicular to first end panel 112 and second top end panel 226 is substantially perpendicular to second end panel 116. First top side panel 402 is rotated about fold line 134 toward interior surface 102 of first side panel 110, and second top side panel 416 is rotated about fold line 158 toward interior surface 102 of second side panel 114. More specifically, after rotation, first top side panel 402 is substantially perpendicular to first side panel 110 and second top side panel 416 is substantially perpendicular to second side panel 114.

In the exemplary embodiment, top side panels 402 and 416 define a gap 454 therebetween when top side panels 402 and 416 are substantially parallel to bottom wall 306. Alternatively, top side panels 402 and 416 are sized such that gap 454 is not defined when top side panels 402 and 416 are substantially parallel to bottom wall 306. In the exemplary embodiment, top side panels 402 and 416 rest on top end panels 170 and 226 while at least top side panels 402 and 416 are secured together using, for example, tape. As such, interior surface 102 of top side panels 402 and/or 416 is adjacent to and/or in direct contact with exterior surface 104 of top end panels 170 and/or 226. Top side panels 402 and 416 and top end panels 170 and 226 define top wall 452 of container 450.

Figure 8:
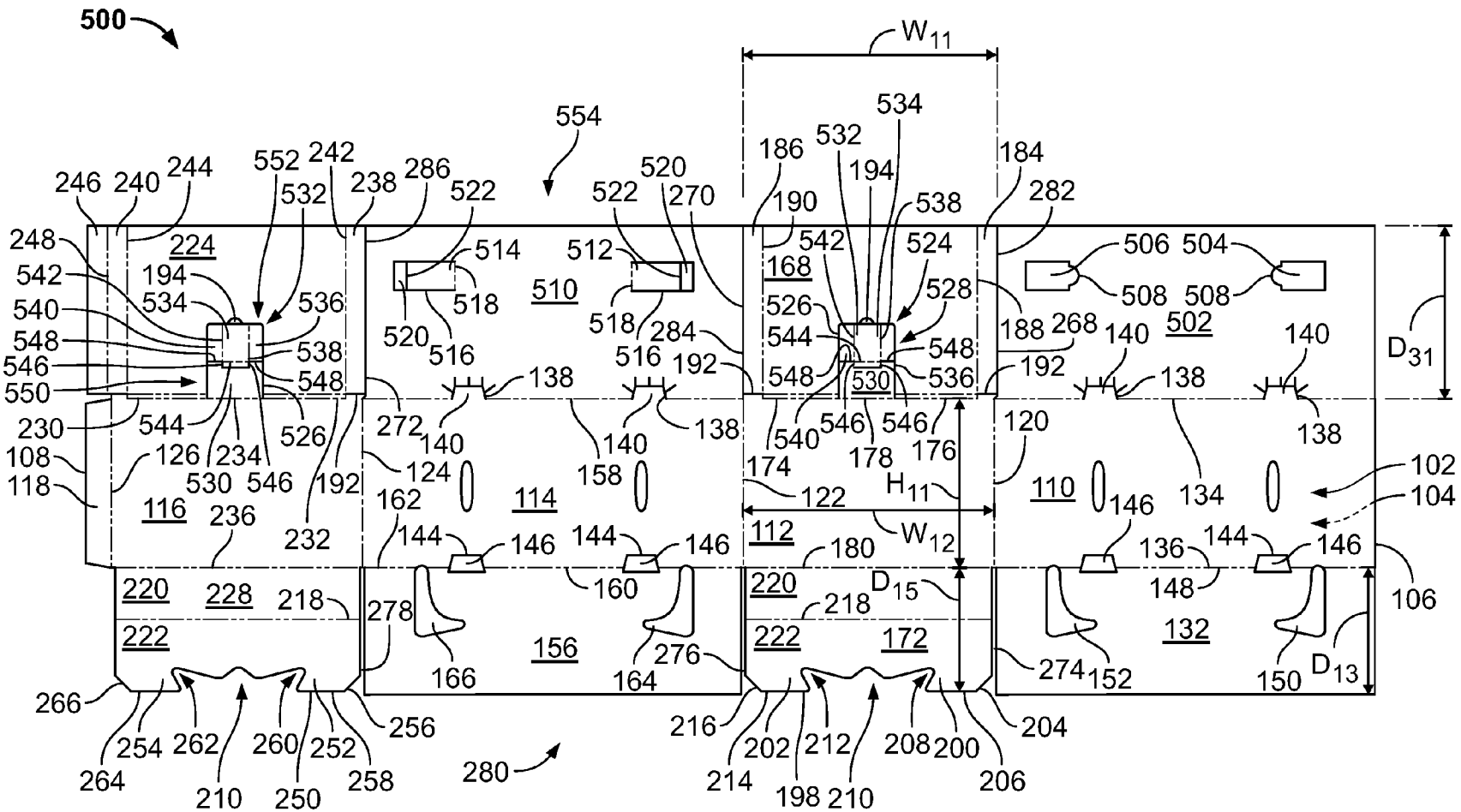
Figure 9:
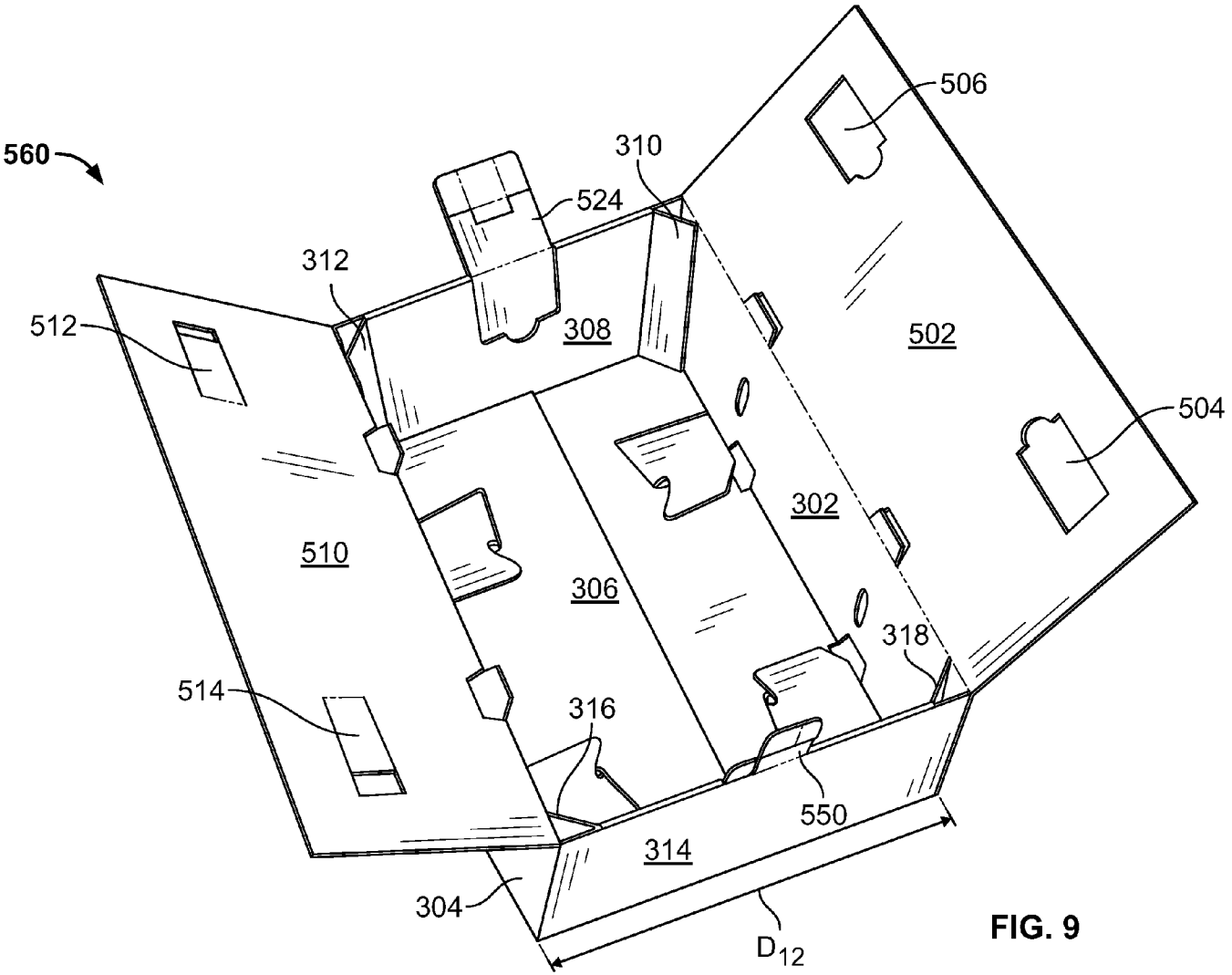
Figure 10:
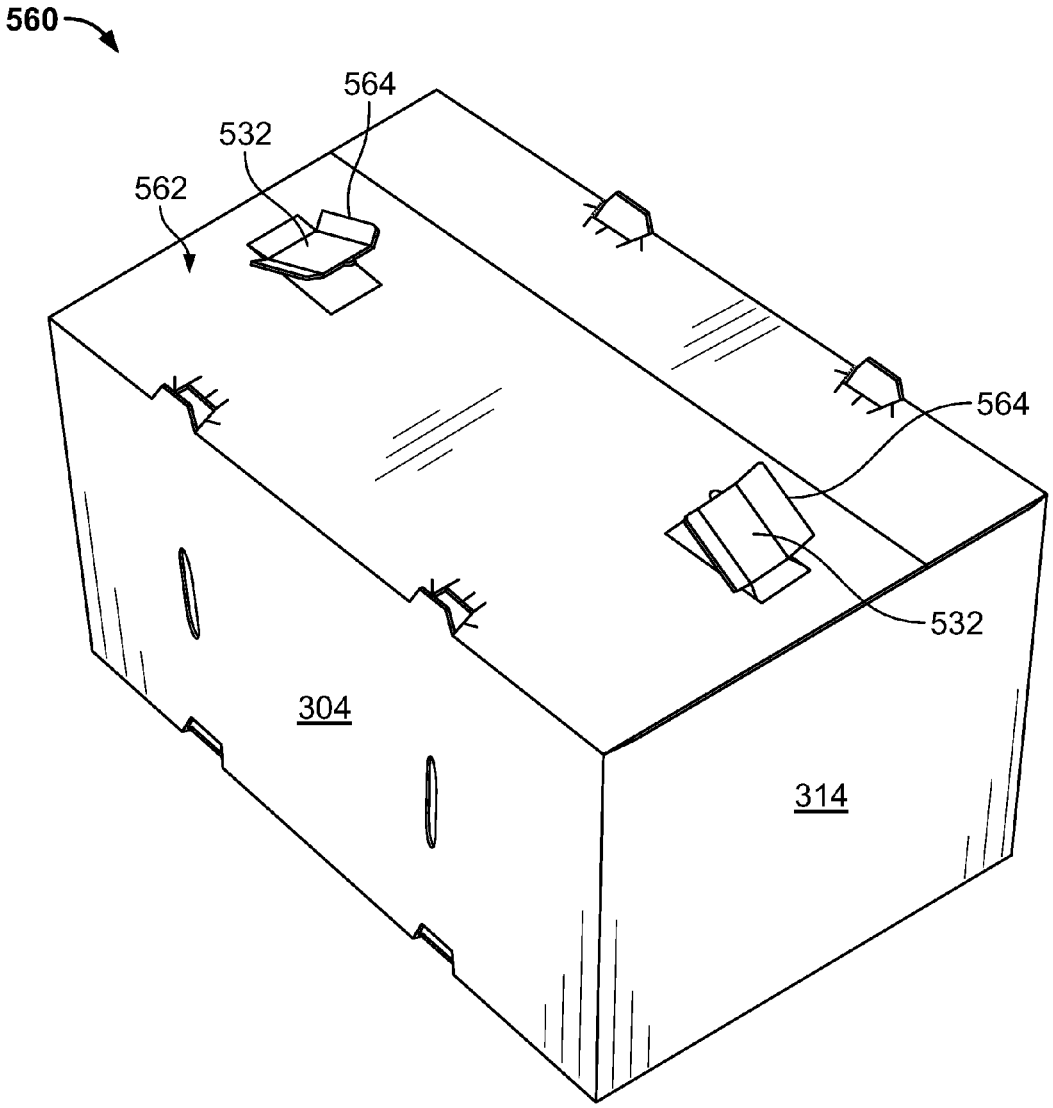

FIG. 8 is a top plan view of a second alternative blank 500 of sheet material. FIG. 9 is a top perspective view of a container 560 formed from blank 500. FIG. 10 is a top perspective view of container 560 with a top wall 562 formed. Unless otherwise described, blank 500 includes components that are similar to the components described above with reference to blank 100 (shown in FIG. 1), and container 560 includes components that are similar to the components described above with reference to container 300 (shown in FIGS. 2-4). As such, components shown in FIGS. 1-4 are labeled with similar reference numbers in FIGS. 8-10.

Referring to FIG. 8, first side panel 110 includes a first top side panel 502 and first bottom side panel 132 extending therefrom along respective fold lines 134 and 136. More specifically, first top side panel 502 extends from first side panel 110 along fold line 134, and first bottom side panel 132 extends from first side panel 110 along fold line 136. In the exemplary embodiment, first top side panel 502 is substantially rectangular and has a depth $D_{31}$ that is more than half of a depth $D_{12}$ (shown in FIG. 9) of container 560. Alternatively, first top side panel 502 has any suitable depth that enables blank 500 and/or container 560 to function as described herein. In the exemplary embodiment, first top side panel 502 includes a first locking cutout 504 and a second locking cutout 506. Locking cutouts 504 and 506 are each substantially rectangular with a semi-circular extension 508, and second locking cutout 506 is a mirror-image of first locking cutout 504. Alternatively, locking cutouts 504 and/or 506 can have any suitable shape, size, and/or configuration that enables blank 500 and/or container 560 to function as described herein.

Similarly, second side panel 114 includes a second top side panel 510 and second bottom side panel 156 extending therefrom along respective fold lines 158 and 160. More specifically, second top side panel 510 extends from second side panel 114 along fold line 158, and second bottom side panel 156 extends from second side panel 114 along fold line 160. In the exemplary embodiment, second top side panel 510 is substantially rectangular and has depth $D_{31}$. Alternatively, second top side panel 510 has any suitable depth that enables blank 500 and/or container 560 to function as described herein. In the exemplary embodiment, second top side panel 510 includes a first locking flap 512 and a second locking flap 514. Each locking flap 512 and 514 is defined by a cut line 516 and a fold line 518. Further, a minor cutout 520 is defined adjacent a free edge 522 of each locking flap 512 and 514. Alternatively, second top side panel 510 does not include cutouts 520. In the exemplary embodiment, locking flaps 512 and 514 are positioned to align with second locking cutout 506 and first locking cutout 504, respectively, when container 560 is formed.

First end panel 112 includes first reinforcing end panel 168, a first top end panel 524, and first bottom end panel 172 extending therefrom along respective fold lines 174, 176, 178, and 180. More specifically, first top end panel 524 extends from first end panel 112 along fold line 178. In the exemplary embodiment, first top end panel 524 is defined within first reinforcing end panel 168 by a cut line 526. More specifically, cut line 526 defines a substantially rectangular and/or square shape of first top end panel 524. Alternatively, first top end panel 524 can have any suitable shape that enables blank 500 and/or container 560 to function as described herein.

In the exemplary embodiment, first top end panel 524 includes a first locking mechanism 528 having a top support panel 530 and a locking tab 532. Locking tab 532 includes a center portion 534, a first side portion 536 extending from center portion 534 along a fold line 538, and a second side portion 540 extending from center portion 534 along a fold line 542. Center portion 534 extends from top support panel 530 along a double fold line 544 and is separated from top support panel 530 at cut lines 546. Side portions 536 and 540 are separated from top support panel 530 by cut lines 548.

Similarly, second end panel 116 includes second reinforcing end panel 224, a second top end panel 550, and second bottom end panel 228 extending therefrom along respective fold lines 230, 232, 234, and 236. More specifically, second top end panel 550 extends from second end panel 116 along fold line 234. In the exemplary embodiment, second top end panel 550 is defined within second reinforcing end panel 224 by cut line 526. More specifically, cut line 526 defines a substantially rectangular and/or square shape of second top end panel 550. Alternatively, second top end panel 550 can have any suitable shape that enables blank 500 and/or container 560 to function as described herein. In the exemplary embodiment, second top end panel 550 includes a second locking mechanism 552 having top support panel 530 and locking tab 532, as described above. A top locking mechanism 554 includes locking cutouts 504 and 506, locking flaps 512 and 514, and locking mechanisms 528 and 552.

Referring to FIGS. 8-10, container 560 is constructed from blank 500 in a manner similar to constructing container 300 (shown in FIGS. 2-4) from blank 100 (shown in FIG. 1). However, to close container 560, first top end panel 524 is rotated about fold line 178 toward interior surface 102 of first end panel 112, and second top end panel 550 is rotated about fold line 234 toward interior surface 102 of second end panel 116. Side portions 536 and 540 are rotated about fold lines 538 and 542 toward exterior surface 104 of center portion 534 for each locking mechanism 528 and 552. Alternatively, side portions 536 and 540 are rotated about fold lines 538 and 542 toward interior surface 102 of center portion 534 for each locking mechanism 528 and/or 552. In the exemplary embodiment, locking tabs 532 are folded slightly about double fold lines 544 toward exterior surface 104 of top support panel 530. First top side panel 502 is rotated about fold line 134 toward interior surface 102 of first side panel 110 such that locking tab 532 of first locking mechanism 528 extends through second locking cutout 506 and locking tab 532 of second locking mechanism 552 extends through first locking cutout 504.

Second top side panel 510 is rotated about fold line 158 toward interior surface 102 of second side panel 114. Locking tab 532 of first locking mechanism 528 extends through minor cutout 520 adjacent first locking flap 512, and locking tab 532 of second locking mechanism 552 extends through minor cutout 520 adjacent second locking flap 514. Alternatively, locking tabs 532 can be pulled upward through locking cutouts 504 and/or 506 and minor cutouts 520 after top side panels 502 and 510 have been rotated about fold lines 134 and 158. In the exemplary embodiment, locking flaps 512 and 514 are rotated slightly about fold lines 518 toward exterior surface 104 of second top side panel 510, and free edges 522 of each locking tab 512 and 514 rest against interior surface 102 of a respective locking tab center portion 534. To secure top locking mechanism 554, side portions 536 and 540 are unfolded with respect to each center portion 534 such that bottom edges 564 of side portions 536 and 540 are adjacent to or in direct contact with exterior surface 104 of second top side panel 510. When container 560 is locked, top support panels 530 and top side panels 502 and 510 are substantially parallel to bottom wall 306. Further, top support panels 530 and top side panels 502 and 510 form top wall 562 of container 560.

Alternatively, first top side panel 502 is rotated about fold line 134 toward interior surface 102 of first side panel 110, and second top side panel 510 is rotated about fold line 158 toward interior surface 102 of second side panel 114. In one embodiment, interior surface 102 of second top side panel 510 is in face-to-face relationship with exterior surface 104 of first top side panel 502. In an alternative embodiment, interior surface 102 of first top side panel 502 is in face-to-face relationship with exterior surface 104 of second top side panel 510. First top side panel 524 is then rotated about fold line 178 toward interior surface 102 of first end panel 112, and second top end panel 550 is rotated about fold line 234 toward interior surface 102 of second end panel 116. Side portions 536 and 540 are rotated about fold lines 538 and 542 toward exterior surface 104 of center portion 534 for each locking mechanism 528 and 552. Alternatively, side portions 536 and 540 are rotated about fold lines 538 and 542 toward interior surface 102 of center portion 534 for each locking mechanism 528 and/or 552. In the exemplary embodiment, locking tabs 532 are folded slightly about double fold lines 544 toward interior surface 102 of top support panel 530. Locking tabs 532 are then inserted into minor cutout 520 and locking cutout 504 and/or 506 to secure top panels 168, 224, 502, and 510 together. In such an embodiment, interior surface 102 of top support panels 530 is in face-to-face relationship with exterior surface 104 of first top side panel 502 and/or second top side panel 510.

Figure 11:
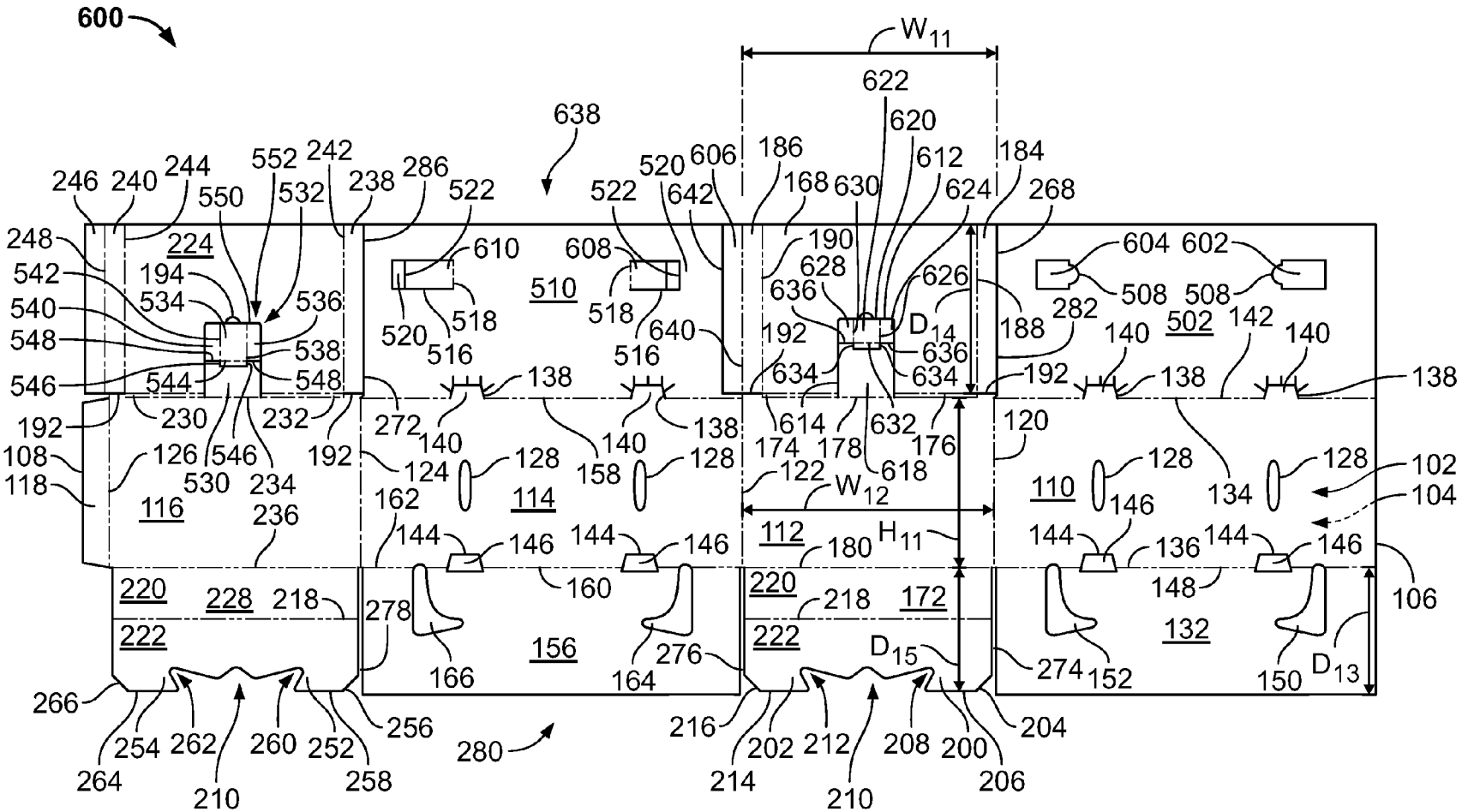
Figure 12:
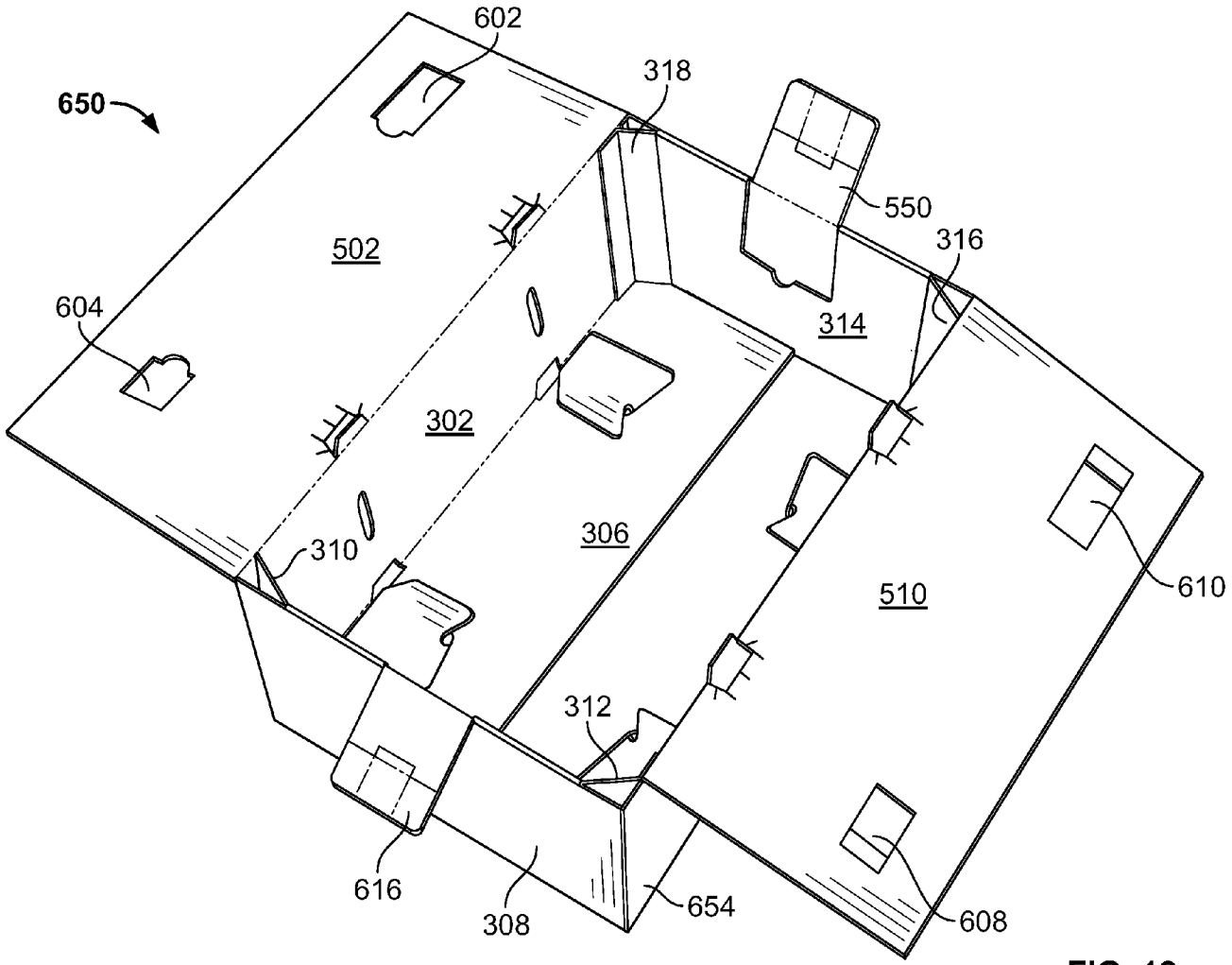
Figure 13:
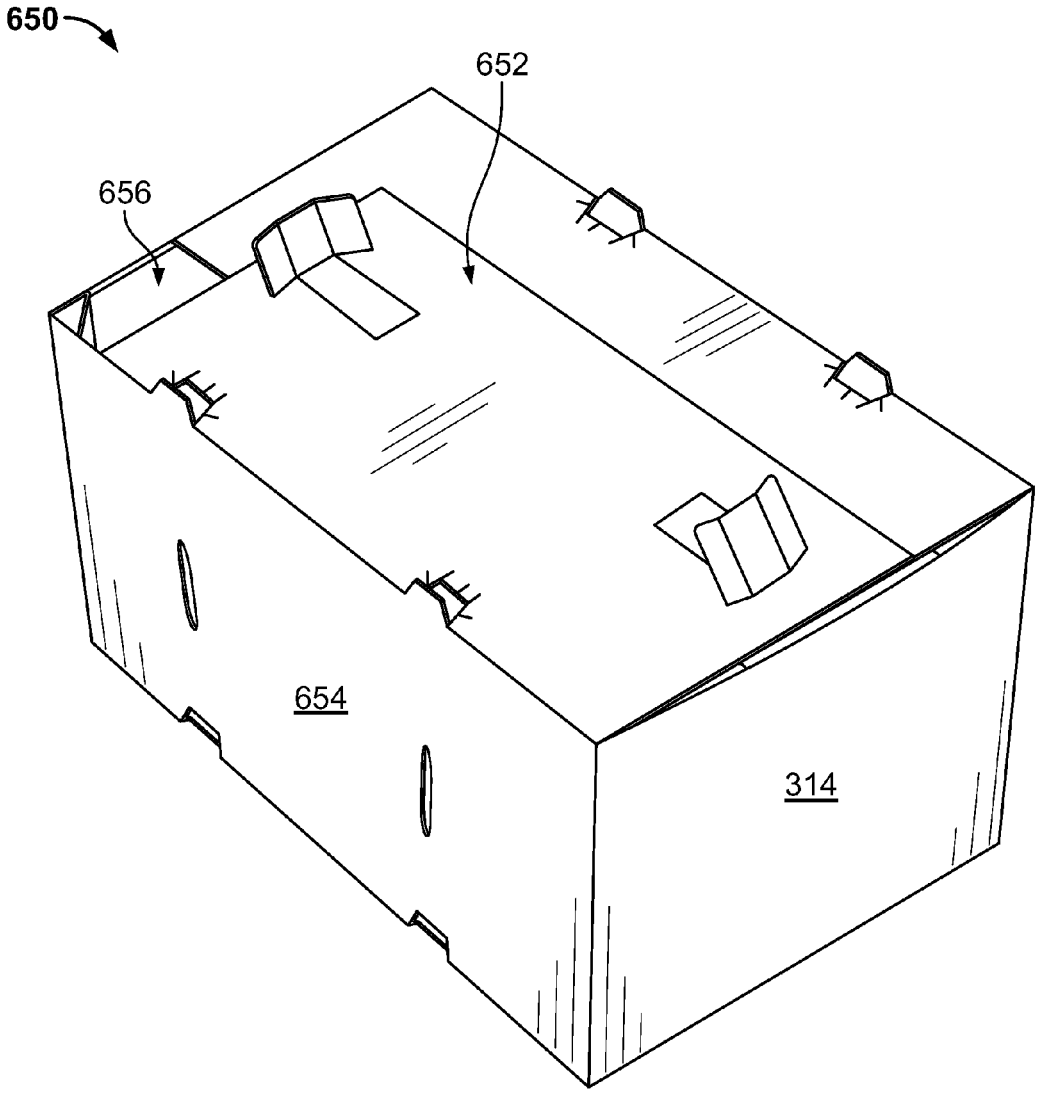

FIG. 11 is a top plan view of a third alternative blank 600 of sheet material. FIG. 12 is a top perspective view of a container 650 formed from blank 600. FIG. 13 is a top perspective view of container 650 with a top wall 652 formed. Unless otherwise described, blank 600 includes components that are similar to the components described above with reference to blank 100 (shown in FIG. 1) and blank 500 (shown in FIG. 8), and container 650 includes components that are similar to the components described above with reference to container 300 (shown in FIGS. 2-4) and container 560 (shown in FIGS. 9 and 10). As such, components shown in FIGS. 1-4 and 8-10 are labeled with similar reference numbers in FIGS. 11-13.

Referring to FIG. 11, in the exemplary embodiment, first top side panel 502 includes a first cutout 602 and a second cutout 604. Cutouts 602 and 604 are each substantially rectangular with semi-circular extension 508, and second cutout 604 is a shorter, mirror-image of first cutout 602. More specifically, second cutout 604 is shorter than first cutout 602 to account for a second side reinforcing panel 606. Alternatively, cutouts 602 and/or 604 can have any suitable shape, size, and/or configuration that enables blank 600 and/or container 650 to function as described herein. Further, in the exemplary embodiment, second top side panel 510 includes a first locking flap 608 and a second locking flap 610. Each locking flap 608 and 610 is defined by cut line 516 and fold line 518. Further, minor cutout 520 is defined adjacent free edge 522 of each locking flap 608 and 610. Alternatively, second top side panel 510 does not include minor cutouts 520. In the exemplary embodiment, locking flaps 608 and 610 are positioned to align with second cutout 604 and first cutout 602, respectively, when container 650 is formed. Further, in the exemplary embodiment, first locking flap 608 is slightly shorter than second locking flap 610 to account for second side reinforcing panel 606 extending into second top side panel 510.

First end panel 112 includes first reinforcing end panel 168, a first top end panel 612, and first bottom end panel 172 extending therefrom along respective fold lines 174, 176, 178, and 180. More specifically, first top end panel 612 extends from first end panel 112 along fold line 178. In the exemplary embodiment, first top end panel 612 is defined within first reinforcing end panel 168 by a cut line 614. More specifically, cut line 614 defines a substantially rectangular and/or square shape of first top end panel 612. Alternatively, first top end panel 612 can have any suitable shape that enables blank 600 and/or container 650 to function as described herein.

First top end panel 612 includes a first locking mechanism 616 having a top support panel 618 and a locking tab 620. Locking tab 620 includes a center portion 622, a first side portion 624 extending from center portion 622 along a fold line 626, and a second side portion 628 extending from center portion 622 along fold line 630. Center portion 622 extends from top support panel 618 along a double fold line 632 and is separated from top support panel 618 and cut lines 634. Side portions 624 and 628 are separated from top support panel 618 by cut lines 636. In the exemplary embodiment, top support panel 618 is longer than top support panel 530 to account for second side reinforcing panel 606 extending into second top side panel 510. A top locking mechanism 638 includes cutouts 602 and 604, locking flaps 608 and 610, and locking mechanisms 616 and 552.

In the exemplary embodiment, first reinforcing end panel 168 includes second side reinforcing panel 606 extending from second corner post panel 186 along a fold line 640. A cut line 642 separates second side reinforcing panel 606 from second top side panel 510. In the exemplary embodiment, second side reinforcing panel 606 is substantially congruent to second corner post panel 186 and extends into second top side panel 510; however, it should be understood that second side reinforcing panel 606 can have any suitable shape and/or configuration that enables blank 600 and/or container 650 to function as described herein.

Referring to FIGS. 11-13, container 650 is constructed from blank 600 in a manner similar to constructing container 560 (shown in FIGS. 9 and 10) from blank 500 (shown in FIG. 8). However, second side reinforcing panel 606 is rotated about fold line 640 toward exterior surface 104 of second corner post panel 186. In the exemplary embodiment, after rotation about fold lines 188, 190, and 640, exterior surface 104 of corner post panels 184 and 186 are oriented at approximately 135° with respect to exterior surface 104 of first reinforcing end panel 168 and exterior surface 104 of second side reinforcing panel 606 is oriented at approximately 135° with respect to exterior surface 104 of second corner post panel 186. As such, exterior surface 104 of second side reinforcing panel 606 is oriented substantially perpendicularly to exterior surface 104 of first reinforcing end panel 168. Alternatively, exterior surface 104 of corner post panels 184 and/or 186 and/or second side reinforcing panel 606 can be oriented at any suitable angled with respect to exterior surface 104 of first reinforcing end panel 168.

When first reinforcing end panel 168 is rotated about double fold lines 174 and 176 toward interior surface 102 of first end panel 112, second side reinforcing panel 606 is rotated into face-to-face relationship with second side panel 114. More specifically, interior surface 102 of second side reinforcing panel 606 is directly adjacent to and/or in direct contact with interior surface 102 of second side panel 114. As such, second side reinforcing panel 606 is included in a second side wall 654. Container 650 is closed similarly to container 560; however top wall 652 of container 650 includes a gap 656 where second side reinforcing panel 606 extended into second top side panel 510 before container 650 was formed.

Figure 14:
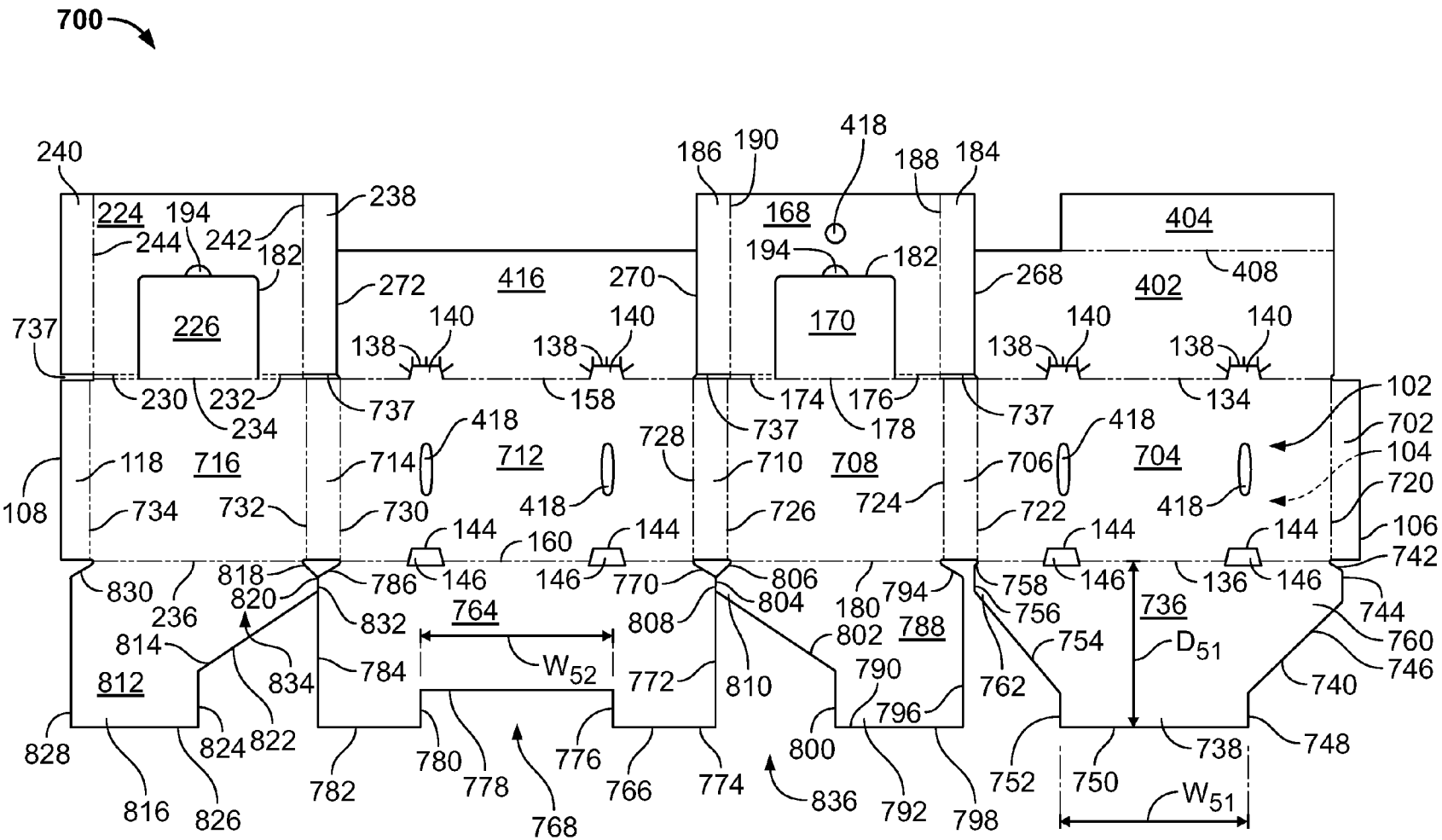
Figure 15:
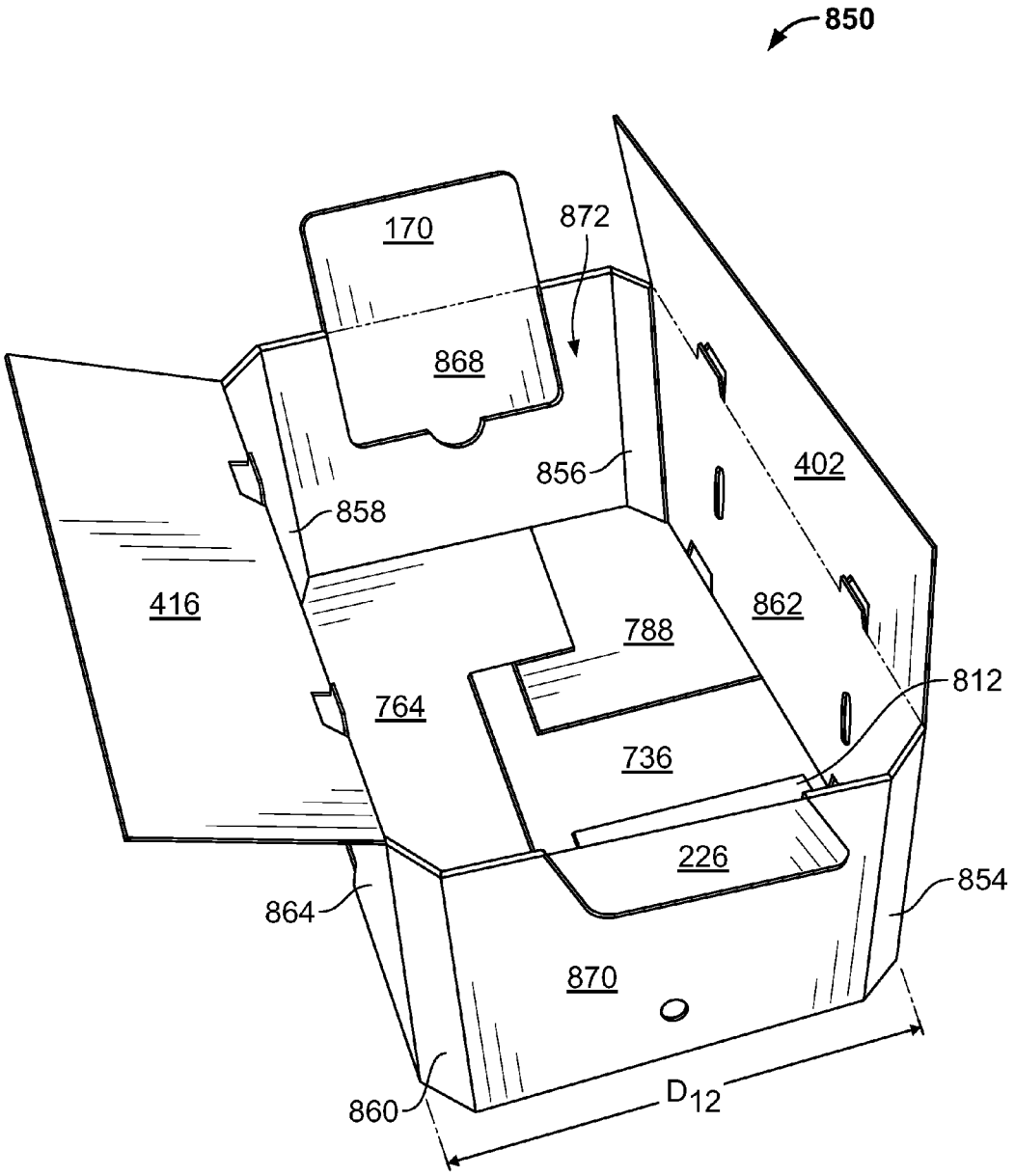
Figure 16:
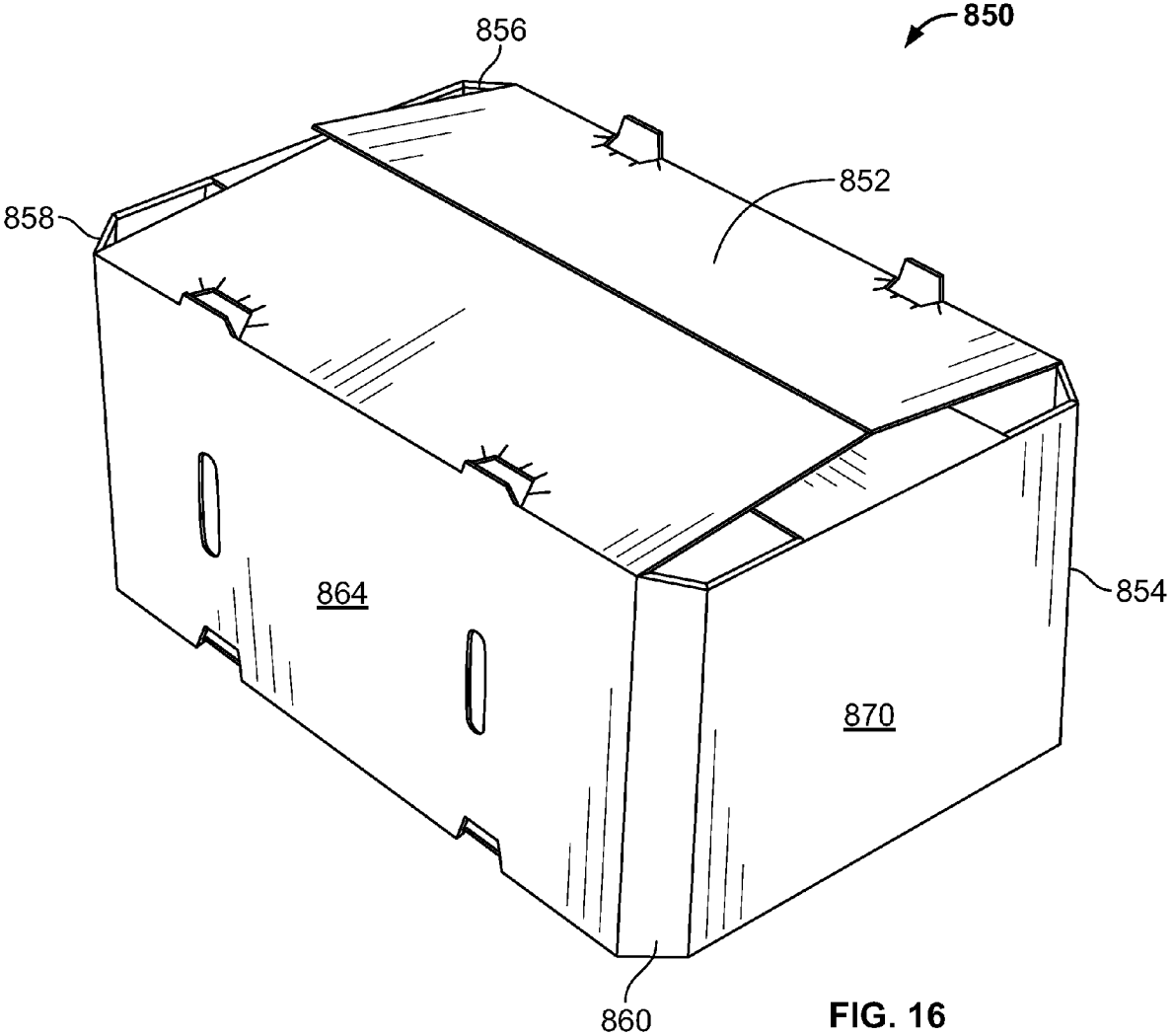
Figure 17:
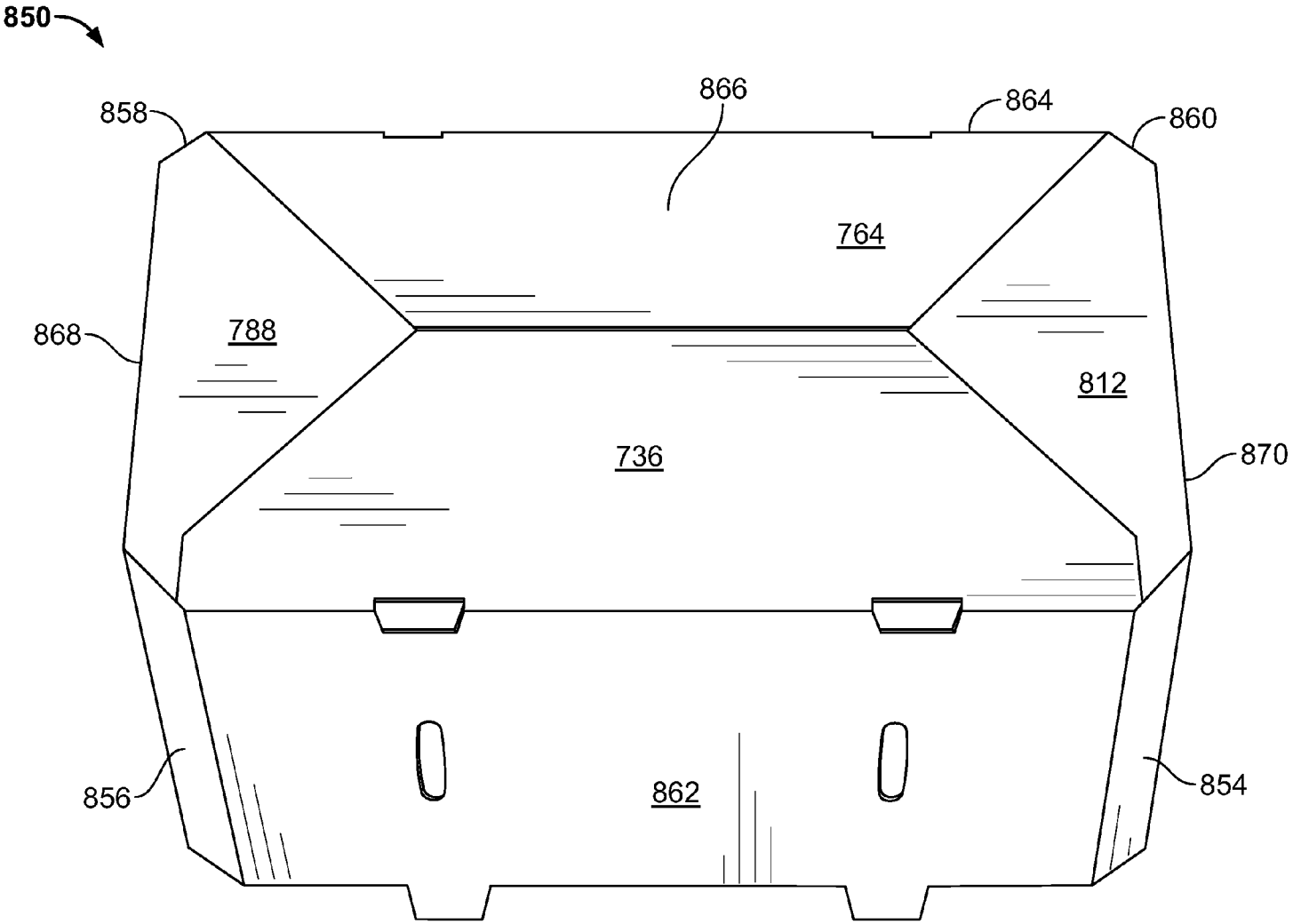

FIG. 14 is a top plan view of a fourth alternative blank 700 of sheet material. FIG. 15 is a top perspective view of a container 850 formed from blank 700. FIG. 16 is a top perspective view of container 850 with a top wall 852 formed. FIG. 17 is a bottom perspective view of container 850. Unless otherwise described, blank 700 includes components that are similar to the components described above with reference to blank 100 (shown in FIG. 1) and blank 400 (shown in FIG. 5), and container 850 includes components that are similar to the components described above with reference to container 300 (shown in FIGS. 2-4) and container 450 (shown in FIGS. 6 and 7). As such, components shown in FIGS. 1-7 are labeled with similar reference numbers in FIGS. 14-17.

Referring to FIG. 14, blank 700 includes, from leading edge 106 to trailing edge 108, a first corner panel 702, a first side panel 704, a second corner panel 706, a first end panel 708, a third corner panel 710, a second side panel 712, a fourth corner panel 714, a second end panel 716, and a glue flap 718 coupled together along preformed, generally parallel, fold lines 720, 722, 724, 726, 728, 730, 732, and 734, respectively. In the exemplary embodiment, corner panels 702, 706, 710, and 714 are each substantially congruent; however, it should be understood that corner panels 702, 706, 710, and/or 714 can each have any suitable size, shape, and/or configuration that enables blank 700 and/or container 850 to function as described herein.

First corner panel 702 extends from first side panel 704 along fold line 720, second corner panel 706 extends from first side panel 704 along fold line 722, first end panel 708 extends from second corner panel 706 along fold line 724, third corner panel 710 extends from first end panel 708 along fold line 726, second side panel 712 extends from third corner panel 710 along fold line 728, fourth corner panel 714 extends from second side panel 712 along fold line 730, second end panel 716 extends from fourth corner panel 714 along fold line 734, and glue flap 718 extends from second end panel 716 along fold line 734. Fold lines 720, 722, 724, 726, 728, 730, 732, and/or 734, as well as other fold lines and/or hinge lines described herein, may include any suitable line of weakening and/or line of separation known to those skilled in the art and guided by the teachings herein provided. In the exemplary embodiment, panels 704, 712, and 168 each include vent holes 418. It should be understood that any panel and/or portion of blank 700 can include vent holes 418 having any suitable shape and/or configuration. In a particular embodiment, blank 700 does not include any vent holes 418.

First side panel 704 includes first top side panel 402 and a first bottom side panel 736 extending therefrom along respective fold lines 134 and 136. More specifically, first top side panel 402 extends from first side panel 704 along fold line 134, and first bottom side panel 736 extends from first side panel 704 along fold line 136. In the exemplary embodiment, first corner post panel 184 and second corner post panel 186 are each separated from corner panels 706 and 710, respectively, by a cutout 737. First bottom side panel 736 has a depth $D_{51}$ that is more than about half of depth $D_{12}$ (shown in FIG. 15) of container 850. Alternatively, first bottom side panel 736 has any suitable depth that enables blank 700 and/or container 850 to function as described herein. In the exemplary embodiment, first bottom side panel 736 includes a locking tab 738 defined by a free edge 740. Locking tab 738 has a width $W_{51}$.

More specifically, free edge 740 includes a first outwardly angled portion 742, a first vertical portion 744, a first inwardly angled portion 746, a second vertical portion 748, a horizontal portion 750, a third vertical portion 752, a second inwardly angled portion 754, a fourth vertical portion 756, and a second outwardly angled portion 758. Outwardly angled portions 742 and 758 are configured based on angles of a first corner wall 854 and a second corner wall 856, respectively. First outwardly angled portion 742, first vertical portion 744, and first inwardly angled portion 746 define a first corner projection 760, and second inwardly angled portion 754, fourth vertical portion 756, and second outwardly angled portion 758 define a second corner projection 762. Locking tab 738 is defined by second vertical portion 748, horizontal portion 750, and third vertical portion 752.

Similarly, second side panel 712 includes second top side panel 416 and a second bottom side panel 764 extending therefrom along respective fold lines 158 and 160. More specifically, second top side panel 416 extends from second side panel 712 along fold line 158, and second bottom side panel 764 extends from second side panel 712 along fold line 160. Third corner post panel 238 and fourth corner post panel 240 are each separated from corner panel 714 and glue flap 718, respectively, by cutout 737. In the exemplary embodiment, second bottom side panel 764 has depth $D_{51}$; however, second bottom side panel 764 can have any suitable depth that enables blank 700 and/or container 850 to function as described herein. In the exemplary embodiment, second bottom side panel 764 includes a free edge 766 that defines a locking slot 768 having a width $W_{52}$ that is slightly wider than width $W_{51}$.

In the exemplary embodiment, free edge 766 includes a first outwardly angled portion 770, a first vertical portion 772, a first horizontal portion 774, a second vertical portion 776, a second horizontal portion 778, a third vertical portion 780, a third horizontal portion 782, a fourth vertical portion 784, and a second outwardly angled portion 786. Outwardly angled portions 770 and 786 are configured based on angles of a third corner wall 858 and a fourth corner wall 860, respectively. Locking slot 768 is at least partially defined by second vertical portion 776, second horizontal portion 778, and third horizontal portion 780.

First end panel 708 includes first reinforcing end panel 168, first top end panel 170, and a first bottom end panel 788 extending therefrom along respective fold lines 174, 176, 178, and 180. More specifically, first bottom end panel 788 extends from first end panel 708 along fold line 180. First bottom end panel 788 has depth $D_{51}$; however, first bottom end panel 788 can have any suitable depth that enables blank 700 and/or container 850 to function as described herein. A free edge 790 of first bottom end panel 788 defines a first locking extension 792.

More specifically, free edge 790 includes a first outwardly angled portion 794, a first vertical portion 796, a horizontal portion 798, a second vertical portion 800, an inwardly angled portion 802, a third vertical portion 804, and a second outwardly angled portion 806. Third vertical portion 804 is separated from first vertical portion 772 of second bottom side panel 764 by a cut line 808. Outwardly angled portions 794 and 806 are configured based on angles of second corner wall 856 and third corner wall 858, respectively. Second outwardly angled portion 806, third vertical portion 804, and inwardly angled portion 802 define a third corner projection 810. First locking extension 792 is defined by first vertical portion 796, horizontal portion 798, and second vertical portion 800.

Similarly, second end panel 716 includes second reinforcing end panel 224, second top end panel 226, and a second bottom end panel 812 extending therefrom along respective fold lines 230, 232, 234, and 236. More specifically, second bottom end panel 812 extends from second end panel 716 along fold line 236. In the exemplary embodiment, second bottom end panel 812 has depth $D_{51}$ and is substantially a mirror-image of first bottom end panel 788. Alternatively, second bottom end panel 812 has any suitable depth and/or configuration that enables blank 700 and/or container 850 to function as described herein.

In the exemplary embodiment, a free edge 814 of second bottom end panel 812 defines a second locking extension 816. More specifically, free edge 814 includes a first outwardly angled portion 818, a first vertical portion 820, an inwardly angled portion 822, a second vertical portion 824, a horizontal portion 826, a third vertical portion 828, and a second outwardly angled portion 830. First vertical portion 820 is separated from fourth vertical portion 784 of second bottom side panel 764 by a cut line 832. Outwardly angled portions 818 and 830 are configured based on angles of fourth corner wall 860 and first corner wall 854, respectively. First outwardly angled portion 818, first vertical portion 820, and inwardly angled portion 822 define a fourth corner projection 834. Second locking extension 816 is defined by second vertical portion 824, horizontal portion 826, and third vertical portion 828.

In the exemplary embodiment, a bottom locking mechanism 836 includes locking tab 738, locking slot 768, and locking extensions 792 and 816. Alternatively, bottom locking mechanism 836 can include any suitable components and/or configuration that enables container 850 to be formed from blank 700.

Referring to FIGS. 14-17, to construct container 850 from blank 700, first corner panel 702 is rotated about fold line 720 toward interior surface 102 of first side panel 704, first side panel 704 is rotated about fold line 722 toward interior surface 102 of second corner panel 706, second corner panel 706 is rotated about fold line 724 toward interior surface 102 of first end panel 708, first end panel 708 is rotated about fold line 726 toward interior surface 102 of third corner panel 710, third corner panel 710 is rotated about fold line 728 toward interior surface 102 of second side panel 712, second side panel 712 is rotated about fold line 730 toward interior surface 102 of fourth corner panel 714, fourth corner panel 714 is rotated about fold line 732 toward interior surface 102 of second end panel 716, and glue flap 718 is rotated about fold line 734 toward interior surface 102 of second end panel 716. In the exemplary embodiment, after rotating panels 702, 704, 706, 708, 710, 712, 714, and 716 and glue flap 718 about fold lines 720, 722, 724, 726, 728, 730, 732, and 734, side panels 704 and 712 are substantially parallel to each other and substantially perpendicular to end panels 708 and 716, and first corner panel 702, glue flap 718, and third corner panel 710 are substantially parallel to each other and substantially perpendicular to second corner panel 706 and fourth corner panel 714. Panels 702, 704, 706, 708, 710, 712, 714, and 716 and glue flap 718 can be rotated about fold lines 720, 722, 724, 726, 728, 730, 732, and 734 by wrapping blank 700 about a mandrel within a machine. Alternatively, a folder/glue machine can be used to convey blank 700 through folder arms and adhesive applicator to form a knocked-down flat container.

Once panels 702, 704, 706, 708, 710, 712, 714, and 716 and glue flap 718 are rotated about fold lines 720, 722, 724, 726, 728, 730, 732, and 734, glue flap 718 is coupled to first corner panel 702. For example, in the exemplary embodiment, interior surface 102 of glue flap 718 is adhered to exterior surface 104 of first corner panel 702. Alternatively, exterior surface 104 of glue flap 718 is adhered to interior surface 102 of first corner panel 702. Further, although adhesive is described herein, glue flap 718 can be coupled to first corner panel 702 used any suitable fastener and/or technique. In the exemplary embodiment, once glue flap 718 is coupled to first corner panel 702, first side panel 704 forms a first side wall 862 of container 850, and second side panel 712 forms a second side wall 864 of container 850. From this configuration, partially formed container 850 can be collapsed into a knocked-down flat configuration for shipping and/or storage of container 850.

To continue construction of container 850, second bottom side panel 764 is rotated about fold line 160 toward interior surface 102 of second side panel 712 to be substantially perpendicular to second side panel 712. First bottom end panel 788 is rotated about fold line 180 toward interior surface 102 of first end panel 708 and into face-to-face relationship with second bottom side panel 764. Similarly, second bottom end panel 812 is rotated about fold line 236 toward interior surface 102 of second end panel 716 and into face-to-face relationship with second bottom side panel 764. More specifically, interior surface 102 of bottom end panels 788 and 812 is directly adjacent to and/or in direct contact with exterior surface 104 of second bottom side panel 764. Locking slot 768 is further defined by locking extensions 792 and 816.

First bottom side panel 736 is then rotated about fold line 136 toward interior surface 102 of first side panel 704. First bottom side panel 736 is rotated toward second bottom side panel 764 and bottom end panels 788 and 812 until panels 736, 764, 788, and 812 are rotated slightly upwardly. More specifically, panels 736, 764, 788, and 812 are rotated such that locking tab 738 can be inserted into locking slot 768. Once locking tab 738 is inserted into locking slot 768, panels 736, 764, 788, and 812 rotate outwardly to be substantially perpendicular to panels 702, 704, 706, 708, 710, 712, 714, and 716 and glue flap 718. When bottom panels 736, 764, 788, and 812 are in the substantially perpendicular configuration, bottom panels 736, 764, 788, and 812 are locked together to form a bottom wall 866 of container 850. As such, bottom locking mechanism 836 interlocks bottom side panels 736 and 764 and bottom end panels 788 and 812 to form bottom wall 866 of container 850, as shown in FIG. 17.

First corner post panel 184 is rotated about fold line 188 toward exterior surface 104 of first reinforcing end panel 168, and second corner post panel 186 is rotated about fold line 190 toward exterior surface 104 of first reinforcing end panel 168. In the exemplary embodiment, after rotation about fold lines 188 and 190, exterior surface 104 of corner post panels 184 and 186 are oriented at approximately 135° with respect to exterior surface 104 of first reinforcing end panel 168. Alternatively, exterior surface 104 of corner post panels 184 and/or 186 can be oriented at any suitable angled with respect to exterior surface 104 of first reinforcing end panel 168. In the exemplary embodiment, first reinforcing end panel 168 is rotated about double fold lines 174 and 176 toward interior surface 102 of first end panel 708. As first reinforcing end panel 168 is rotated, first top end panel 170 remains substantially planar with first end panel 708. First reinforcing end panel 168 is rotated into face-to-face relationship with first end panel 708. More specifically, interior surface 102 of first reinforcing end panel 168 is directly adjacent to and/or in direct contact with interior surface 102 of first end panel 708. First reinforcing end panel 168 and first end panel 708 define a first end wall 868.

Further, first corner post panel 184 is rotated into face-to-face relationship with second corner panel 706, and second corner post panel 186 is rotated into face-to-face relationship with third corner panel 710. First corner post panel 184 and second corner panel 706 define second corner wall 856, and second corner post panel 186 and third corner panel 710 define third corner wall 858.

Third corner post panel 238 is rotated about fold line 242 toward exterior surface 104 of second reinforcing end panel 224, and fourth corner post panel 240 is rotated about fold line 244 toward exterior surface 104 of second reinforcing end panel 224. In the exemplary embodiment, after rotation about fold lines 242 and 244, exterior surface 104 of corner post panels 238 and 240 is oriented at approximately 135° with respect to exterior surface 104 of second reinforcing end panel 224. Alternatively, exterior surface 104 corner post panels 238 and/or 240 can be oriented at any suitable angled with respect to exterior surface 104 of second reinforcing end panel 224. In the exemplary embodiment, second reinforcing end panel 224 is rotated about double fold lines 230 and 232 toward interior surface 102 of second end panel 716. As second reinforcing end panel 224 is rotated, second top end panel 226 remains substantially planar with second end panel 716. Second reinforcing end panel 224 is rotated into face-to-face relationship with second end panel 716. More specifically, interior surface 102 of second reinforcing end panel 224 is directly adjacent to and/or in direct contact with interior surface 102 of second end panel 716. Second reinforcing end panel 224 and second end panel 716 define a second end wall 870.

Further, third corner post panel 238 is rotated into face-to-face relationship with fourth corner panel 714, and fourth corner post panel 240 is rotated into face-to-face relationship with first corner panel 702 and/or glue flap 718. Third corner post panel 238 and fourth corner panel 714 define fourth corner wall 860, and fourth corner post panel 240, first corner panel 702, and glue flap 718 define first corner wall 854. Corner walls 854, 856, 858, and 860, side walls 862 and 864, end walls 868 and 870, and bottom wall 866 define a cavity 872 of container 850. When corner walls 854, 856, 858, and 860, side walls 862 and 864, end walls 868 and 870, and bottom wall 866, container 850 is considered to be in an open configuration, as shown in FIG. 15. To close container 850, top wall 852 is formed similarly to top wall 452 (shown in FIGS. 6 and 7) of container 450, as shown in FIG. 16.

The above-described embodiments provide reinforced containers for shipping and/or storing products in a stacked configuration. More specifically, because the end walls are reinforced and the containers described herein include corner posts, the above-described containers can be stacked without the containers substantially deforming from compression forces applied by upper containers. Further, the embodiments described herein provide a single blank of sheet material for forming a reinforced container. As such, no additionally inserts are needed to provide the reinforcement to the container. Rather, the corner posts are integrally formed with a reinforcing end panel. Additionally, the above-described alignment panel facilitates automated construction of containers from the blanks by enabling a machine to properly align the blanks. Moreover, the embodiments including the alignment panel can be used with known taping machines because the top side panels do not overlap.

Exemplary embodiments of blanks and methods for forming reinforced containers are described above in detail. The apparatus and methods are not limited to the specific embodiments described herein, but rather, components of apparatus and/or steps of the methods may be utilized independently and separately from other components and/or steps described herein. For example, the methods may also be used in combination with other reinforced containers and methods, and are not limited to practice with only the reinforced containers and methods as described herein. Rather, the exemplary embodiment can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank of sheet material for forming a container, the blank comprising:

a series of side and end panels connected by a plurality of fold lines, the series of panels comprising a first end panel;

a first reinforcing end panel extending from the first end panel;

a first corner post panel extending from a first edge of the first reinforcing end panel; and a first top end panel defined within the first reinforcing end panel and extending from the first end panel.

2. A blank of sheet material in accordance with claim 1 further comprising a second corner post panel extending from a second edge of the first reinforcing end panel, the second edge opposing the first edge.

3. A blank of sheet material in accordance with claim 1 further comprising a first side reinforcing panel extending from an edge of the first corner post panel.

4. A blank of sheet material in accordance with claim 1 further comprising a second reinforcing end panel extending from a second end panel of the series of panels.

5. A blank of sheet material in accordance with claim 4 further comprising a third corner post panel extending from a first edge of the second reinforcing panel and a fourth corner post panel extending from a second, opposing edge of the second reinforcing end panel.

6. A blank of sheet material in accordance with claim 5 further comprising a second side reinforcing panel extending from an edge of one of the third corner post panel and the fourth corner post panel.

7. A blank of sheet material in accordance with claim 1, wherein the first top end panel comprises a locking mechanism.

8. A blank of sheet material in accordance with claim 7 further comprising:

a first top side panel extending from a first side panel, the first top side panel comprising a cutout; and a second top side panel extending from a second side panel, the second top side panel comprising a locking flap, the locking mechanism configured to be inserted through the cutout and secured in position by the locking flap.

9. A blank of sheet material in accordance with claim 1 further comprising:

a first bottom end panel extending from the first end panel, the first bottom end panel comprising a first locking extension;

a second bottom end panel extending from a second end panel of the series of panels, the second bottom end panel comprising a second locking extension; and a first bottom side panel extending from a first side panel of the series of panels, the first bottom side panel comprising a locking slot formed in cooperation with the first locking extension and the second locking extension.

10. A blank of sheet material in accordance with claim 9 further comprising a second bottom side panel extending from a second side panel of the series of panels, the second bottom side panel comprising a locking tab configured to be received in the locking slot.

11. A container formed from a blank of sheet material, the container comprising:

a first end wall formed from a first end panel and an interconnected first reinforcing end panel positioned in face-to-face relationship with the first end panel;

a first top end panel extending from the first end panel; and a bottom wall oriented substantially perpendicularly to the first end wall, the bottom wall comprising a plurality of bottom panels interlocked together using a bottom locking mechanism, said bottom locking mechanism comprising a locking slot defined by three bottom panels of the plurality of bottom panels and a locking tab defined by one bottom panel of the plurality of bottom panels, the locking tab received within the locking slot to form the bottom wall.

12. A container in accordance with claim 11 wherein the container is four-sided.

13. A container in accordance with claim 12 further comprising a first side wall, an opposing second side wall, a second end wall opposing the first end wall, and at least one corner post extending between at least one of the first side wall and the first end wall, the first side wall and the second end wall, the second side wall and the first end wall, and the second side wall and the second end wall.

14. A container in accordance with claim 13, wherein at least one of the first side wall and the second side wall comprising a side reinforcing panel.

15. A container in accordance with claim 11 wherein the container is eight-sided.

16. A container in accordance with claim 15, wherein the container comprises a plurality of corner walls, at least one corner wall of the plurality of corner walls comprising a corner panel and a corner post panel.

17. A container in accordance with claim 11 further comprising a top wall comprising a first top side panel, a second top side panel, the first top end panel, and a second top end panel.

18. A container in accordance with claim 17, wherein the first top side panel comprises a first locking cutout and a second locking cutout;

the second top side panel comprises a first locking flap and a second locking flap, a minor cutout is defined adjacent to each of the locking flaps; and each top end panel comprises a locking mechanism configured to be received in a minor cutout and one of the first locking cutout and the second locking cutout and secured by one of the first locking flap and the second locking flap to form the top wall.

19. A method for forming a container from a blank of sheet material, the blank including a series of side and end panels connected by a plurality of fold lines, at least one reinforcing end panel connected to at least one panel of the series of panels, at least one corner post panel extending from the at least one reinforcing end panel, and an upper end panel extending from the at least one panel of the series of panels, the method comprising:

rotating the series of panels about the plurality of fold lines to form at least a portion of a first side wall, an opposing second side wall, a first end wall, and an opposing second end wall;

rotating the at least one reinforcing end panel with respect to at least one of the first end wall and the second end wall and the upper end panel extending from the at least one of the first end wall and the second end wall to form a portion of the at least one of the first end wall and the second end wall; and rotating the at least one corner post panel with respect to the at least one reinforcing end panel to form at least one corner post within the container.

20. A method in accordance with claim 19 further comprising forming a bottom wall by interlocking a plurality of bottom panels together.

21. A method in accordance with claim 20 wherein forming a bottom wall comprises inserting a locking tab into a locking slot, the locking tab and the locking slot defined by a plurality of bottom panels.

22. A method in accordance with claim 19 further comprising:

rotating a plurality of top panels with respect to the series of panels; and interlocking the plurality of top panels together using locking cutouts, locking tabs, minor cutouts, and locking slots defined by the plurality of top panels.

23. A locking mechanism for use with a container formed from a blank of sheet material, the blank including a first top panel, a second top panel, a third top panel, and a fourth top panel, the locking mechanism comprising:

a first locking cutout and a second locking cutout defined in the first top panel;

a first locking flap and a second locking flap defined by the second top panel;

a first minor cutout adjacent the first locking flap and a second minor cutout adjacent the second locking flap, wherein the first and second minor cutouts are defined through the second top panel; and a first locking tab defined by the third top panel and a second locking tab defined by the fourth top panel, the first locking tab configured to be inserted through the first locking cutout and the first minor cutout and secured in position by the first locking flap, and the second locking tab configured to be inserted through the second locking cutout and the second minor cutout and secured in position by the second locking flap.

24. A locking mechanism in accordance with claim 23, wherein the first and second locking tabs each comprise:

an upper support panel configured to extend below the first top panel between a top edge of an end panel and the at least one cutout;

a center portion extending from the top support panel; and a pair of side flaps each extending from a side edge of the center portion, the side flaps configured to engage the second top panel adjacent the first and second locking flaps when the first and second locking tabs are interlocked with the first and second cutouts and the first and second locking flaps.

* * * * *